US008640586B2

(12) United States Patent
Jaynes

(10) Patent No.: US 8,640,586 B2
(45) Date of Patent: Feb. 4, 2014

(54) METHOD AND APPARATUS FOR FACILITATING CUTTING OF A UNIT DOSE BLISTER CARD

(75) Inventor: Robert Jaynes, Pittsburgh, PA (US)

(73) Assignee: McKesson Automation Inc., Cranberry, PA (US)

( * ) Notice: Subject to any disclaimer, the term of this patent is extended or adjusted under 35 U.S.C. 154(b) by 706 days.

(21) Appl. No.: 12/729,706

(22) Filed: Mar. 23, 2010

(65) Prior Publication Data

US 2011/0232435 A1 Sep. 29, 2011

(51) Int. Cl.

| | |
|---|---|
| ***B26D 5/00*** | (2006.01) |
| ***B26D 7/02*** | (2006.01) |
| ***B26D 1/08*** | (2006.01) |

(52) U.S. Cl.

USPC ..... 83/375; 83/400; 83/61; 83/452

(58) Field of Classification Search

USPC ..... 83/13, 375, 400, 61, 452, 362, 367, 83/371, 467.1, 468, 468.7, 520, 521, 83/522.17, 522.18, 522.19; 250/548

See application file for complete search history.

(56) References Cited

U.S. PATENT DOCUMENTS

| | | | | | |
|---|---|---|---|---|---|
| 635,457 | A | | 10/1899 | Yandall | |
| 678,441 | A | | 7/1901 | Stevens | |
| 2,270,473 | A | | 1/1942 | Porcelli | |
| 3,160,048 | A | * | 12/1964 | Barley | 83/390 |
| 3,182,542 | A | * | 5/1965 | Cochran | 83/453 |
| 3,656,391 | A | * | 4/1972 | Von Arx | 83/521 |
| 4,253,364 | A | | 3/1981 | Kiefer et al. | |
| 4,337,679 | A | | 7/1982 | Krylov et al. | |
| 4,679,473 | A | | 7/1987 | Hirata et al. | |
| 4,716,799 | A | | 1/1988 | Hartmann | |
| 4,717,042 | A | | 1/1988 | McLaughlin | |
| 4,785,969 | A | | 11/1988 | McLaughlin | |
| 4,847,764 | A | | 7/1989 | Halvorson | |
| 4,932,301 | A | | 6/1990 | Buck | |
| 5,014,875 | A | | 5/1991 | McLaughlin et al. | |
| 5,048,816 | A | | 9/1991 | Chun et al. | |
| 5,131,301 | A | * | 7/1992 | Gergek | 83/13 |
| 5,190,185 | A | | 3/1993 | Blechl | |
| 5,314,243 | A | | 5/1994 | McDonald et al. | |
| 5,346,297 | A | | 9/1994 | Colson, Jr. et al. | |
| 5,377,572 | A | | 1/1995 | Sonobe et al. | |
| 5,377,864 | A | | 1/1995 | Blechl et al. | |
| 5,405,048 | A | | 4/1995 | Rogers et al. | |
| 5,431,299 | A | | 7/1995 | Brewer et al. | |
| 5,460,294 | A | | 10/1995 | Williams | |
| 5,468,110 | A | | 11/1995 | McDonald et al. | |
| 5,480,062 | A | | 1/1996 | Rogers et al. | |
| 5,520,450 | A | | 5/1996 | Colson, Jr. et al. | |
| 5,564,803 | A | | 10/1996 | McDonald et al. | |

(Continued)

*Primary Examiner* — Ghassem Alie

(74) *Attorney, Agent, or Firm* — Alston & Bird LLP

(57) ABSTRACT

An apparatus for facilitating cutting of unit dose blisters from a blister card is provided. The apparatus may include a platform, a clamp, a blade and a sensor. The blister card may be positionable on the platform for cutting. The clamp may be positionable to hold a portion of the blister card in contact with the platform for cutting when the clamp is seated. The clamp may be operatively coupled to a guillotine head. The blade may also be operatively coupled to the guillotine head. The guillotine head may be configured to move the blade through a range of motion that intersects a plane of the platform. The sensor may be positioned to detect a seating status of the clamp to enable control of movement of the guillotine head based on the seating status.

5 Claims, 15 Drawing Sheets

(56) References Cited

U.S. PATENT DOCUMENTS

| | | | |
|---|---|---|---|
| 5,593,267 | A | 1/1997 | McDonald et al. |
| 5,630,347 | A | 5/1997 | Elvio |
| 5,661,978 | A | 9/1997 | Holmes et al. |
| D384,578 | S | 10/1997 | Wangu et al. |
| 5,713,485 | A | 2/1998 | Liff et al. |
| 5,716,114 | A | 2/1998 | Holmes et al. |
| 5,745,366 | A | 4/1998 | Higham et al. |
| 5,761,877 | A | 6/1998 | Quandt |
| 5,797,515 | A | 8/1998 | Liff et al. |
| 5,805,456 | A | 9/1998 | Higham et al. |
| 5,807,222 | A | 9/1998 | Totani |
| 5,842,976 | A | 12/1998 | Williamson |
| 5,878,885 | A | 3/1999 | Wangu et al. |
| 5,880,443 | A | 3/1999 | McDonald et al. |
| 5,883,806 | A | 3/1999 | Meador et al. |
| 5,893,697 | A | 4/1999 | Zini et al. |
| 5,905,653 | A | 5/1999 | Higham et al. |
| 5,912,818 | A | 6/1999 | McGrady et al. |
| 5,927,540 | A | 7/1999 | Godlewski |
| 5,940,306 | A | 8/1999 | Gardner et al. |
| 5,971,593 | A | 10/1999 | McGrady |
| 6,003,006 | A | 12/1999 | Colella et al. |
| 6,011,999 | A | 1/2000 | Holmes |
| 6,021,392 | A | 2/2000 | Lester et al. |
| 6,035,610 | A | 3/2000 | Vonderhorst et al. |
| 6,039,467 | A | 3/2000 | Holmes |
| 6,065,819 | A | 5/2000 | Holmes et al. |
| 6,068,156 | A | 5/2000 | Liff et al. |
| 6,109,774 | A | 8/2000 | Holmes et al. |
| 6,112,502 | A | 9/2000 | Frederick et al. |
| 6,116,461 | A | 9/2000 | Broadfield et al. |
| 6,151,536 | A | 11/2000 | Arnold et al. |
| 6,170,230 | B1 | 1/2001 | Chudy et al. |
| 6,176,392 | B1 | 1/2001 | William et al. |
| 6,189,727 | B1 | 2/2001 | Shoenfeld |
| 6,223,934 | B1 | 5/2001 | Shoenfeld |
| 6,256,967 | B1 | 7/2001 | Hebron et al. |
| 6,283,322 | B1 | 9/2001 | Liff et al. |
| 6,289,656 | B1 | 9/2001 | Wangu et al. |
| 6,338,007 | B1 | 1/2002 | Broadfield et al. |
| 6,339,732 | B1 | 1/2002 | Phoon et al. |
| 6,361,263 | B1 | 3/2002 | Dewey et al. |
| 6,370,841 | B1 | 4/2002 | Chudy et al. |
| 6,449,927 | B2 | 9/2002 | Hebron et al. |
| 6,471,089 | B2 | 10/2002 | Liff et al. |
| 6,497,342 | B2 | 12/2002 | Zhang et al. |
| 6,499,270 | B2 | 12/2002 | Peroni et al. |
| 6,532,399 | B2 | 3/2003 | Mase |
| 6,564,121 | B1 | 5/2003 | Wallace et al. |
| 6,581,798 | B2 | 6/2003 | Liff et al. |
| 6,609,047 | B1 | 8/2003 | Lipps |
| 6,611,733 | B1 | 8/2003 | De La Huerga |
| 6,625,952 | B1 | 9/2003 | Chudy et al. |
| 6,640,159 | B2 | 10/2003 | Holmes et al. |
| 6,650,964 | B2 | 11/2003 | Spano, Jr. et al. |
| 6,671,579 | B2 | 12/2003 | Spano, Jr. et al. |
| 6,681,149 | B2 | 1/2004 | William et al. |
| 6,742,671 | B2 | 6/2004 | Hebron et al. |
| 6,755,931 | B2 | 6/2004 | Vollm et al. |
| 6,760,643 | B2 | 7/2004 | Lipps |
| 6,776,304 | B2 | 8/2004 | Liff et al. |
| 6,785,589 | B2 | 8/2004 | Eggenberger et al. |
| 6,790,198 | B1 | 9/2004 | White et al. |
| 6,793,424 | B2 | 9/2004 | Yamada et al. |
| 6,814,254 | B2 | 11/2004 | Liff et al. |
| 6,814,255 | B2 | 11/2004 | Liff et al. |
| 6,847,861 | B2 | 1/2005 | Lunak et al. |
| 6,874,684 | B1 | 4/2005 | Denenberg et al. |
| 6,892,780 | B2 | 5/2005 | Vollm et al. |
| 6,895,304 | B2 | 5/2005 | Spano, Jr. et al. |
| 6,975,922 | B2 | 12/2005 | Duncan et al. |
| 6,985,797 | B2 | 1/2006 | Spano, Jr. et al. |
| 6,996,455 | B2 | 2/2006 | Eggenberger et al. |
| 7,010,389 | B2 | 3/2006 | Lunak et al. |
| 7,014,063 | B2 | 3/2006 | Shows et al. |
| 7,016,766 | B2 | 3/2006 | William et al. |
| 7,040,504 | B2 | 5/2006 | Broadfield et al. |
| 7,052,097 | B2 | 5/2006 | Meek, Jr. et al. |
| 7,072,737 | B2 | 7/2006 | Lunak et al. |
| 7,072,855 | B1 | 7/2006 | Godlewski et al. |
| 7,077,286 | B2 | 7/2006 | Shows et al. |
| 7,085,621 | B2 | 8/2006 | Spano, Jr. et al. |
| 7,092,796 | B2 | 8/2006 | Vanderveen |
| 7,093,755 | B2 | 8/2006 | Jordan et al. |
| 7,100,792 | B2 | 9/2006 | Hunter et al. |
| 7,103,419 | B2 | 9/2006 | Engleson et al. |
| 7,111,780 | B2 | 9/2006 | Broussard et al. |
| 7,139,639 | B2 | 11/2006 | Broussard et al. |
| 7,150,724 | B2 | 12/2006 | Morris et al. |
| 7,171,277 | B2 | 1/2007 | Engleson et al. |
| 7,218,231 | B2 | 5/2007 | Higham |
| 7,228,198 | B2 | 6/2007 | Vollm et al. |
| 7,249,688 | B2 | 7/2007 | Hunter et al. |
| 7,348,884 | B2 | 3/2008 | Higham |
| 7,417,729 | B2 | 8/2008 | Greenwald |
| 7,419,133 | B2 | 9/2008 | Clarke et al. |
| 7,426,425 | B2 | 9/2008 | Meek, Jr. et al. |
| 7,428,859 | B2 * | 9/2008 | Fujita et al. ..... 83/456 |
| 7,540,222 | B2 | 6/2009 | Kim |
| 7,554,449 | B2 | 6/2009 | Higham |
| 7,571,024 | B2 | 8/2009 | Duncan et al. |
| 7,588,167 | B2 | 9/2009 | Hunter et al. |
| 7,748,628 | B2 | 7/2010 | Greyshock |
| 8,036,773 | B2 | 10/2011 | Braun et al. |
| 2006/0123969 | A1 | 6/2006 | Fujita et al. |
| 2007/0261525 | A1 * | 11/2007 | Yamaguchi et al. ..... 83/78 |
| 2007/0265730 | A1 | 11/2007 | Greyshock |

* cited by examiner

METHOD AND APPARATUS FOR FACILITATING CUTTING OF A UNIT DOSE BLISTER CARD

FIELD OF THE INVENTION

Exemplary embodiments of the present invention relate generally to automated cutting of media such as media including units on a unit dose blister card.

BACKGROUND OF THE INVENTION

In a typical hospital, nursing home, or other similar institution, doctors will visit their patients on a routine basis and prescribe various medications for each patient. In turn, each patient will likely be placed on a certain medication treatment plan that requires that he or she take one or more doses of various medications daily. Some medications may require that they be administered only at certain times of the day (e.g., after meals) and/or at intervals of one or more hours each day. In addition, patients may request certain medications on an elective basis for complaints, such as head or body aches. These requests are typically included with the doctor's medication request or prescription that he or she sends to a pharmacy of the hospital for filling.

Medication requests or prescriptions received by the pharmacy will likely be checked by a registered pharmacist and then entered into the pharmacy information system. These requests reflect not only orders that are added to a particular patient's treatment plan, but also changes in a patient's existing treatment plan. The pharmacy information system combines this information with the patient's existing medication schedule and develops a patient medication profile. Using the patient medication profile, a fill list can be created that lists all medications that must be distributed to all patients for a given time period (e.g., a day).

In some instances, this list is printed and used by a pharmacist or pharmacy technician to hand pick each of the drugs needed for each patient (in the form of unit doses) and place those drugs in corresponding patient-specific medication containers (e.g., drawers, boxes, bins or bags). A registered pharmacist then checks the accuracy of the patient order, and, assuming the order was accurate, the individual patient boxes are loaded into a large transport cart and delivered to a nursing unit.

Several drawbacks exist, however, to this method of medication retrieval and distribution. In particular, it is very time consuming and manpower intensive. As a result, systems were created for automating the process of retrieving unit dose medications and distributing them to patients according to their respective medication profiles. One example of such a system is the ROBOT-Rx® system, offered by McKesson Automation Inc. and described in U.S. Pat. Nos. 5,468,110, 5,593,267 and 5,880,443, and other examples are described in U.S. patent application Ser. Nos. 11/382,605, filed May 10, 2006, 11/611,956, filed Dec. 18, 2006 and 11/755,207, filed May 30, 2007, the contents of which are hereby incorporated herein by reference.

The ROBOT-Rx® system, like other similar systems, is a stationary robotic system that automates the drug storing, dispensing, returning, restocking and crediting process by using barcode technology. In particular, single doses of medications are re-packaged, for example in a clear plastic bag, so that each package contains a barcode corresponding to the package contents. The barcode may include the name of the medication, quantity, weight, instructions for use and/or expiration date.

The packaged medications are then stored in a storage area, such as a storage rack having a frame and a plurality of rod supports on which each package can be hung in a manner that provides each with an X, Y coordinate. Using the X, Y coordinates, packages can then be selected by an automated picking means (e.g., a robotic arm capable of moving at least in three, mutually orthogonal directions designated X, Y and Z), for distribution to individual patients.

More specifically, in one instance, a pharmacist or technician may manually enter the identification of a specific medication he or she would like the automated system to retrieve, for example, as a patient's first dose, in an emergency situation. The automated system, and, in particular, a computer associated with the automated system, would then locate the desired medication (i.e., the X, Y and Z coordinates of the medication) and instruct the picking means to retrieve the medication at that location. In another instance, the fill list created based on each patient's medication profile may be communicated to the computer associated with the automated system, providing the automated system with a current list of all patients and their individual medication needs. The computer also maintains a database of all medications stored in the storage area along with their corresponding X, Y and Z coordinates.

Patient-specific containers (e.g., drawers or bins) displaying barcodes that include the corresponding patient's unique identification code are placed on a conveyer belt associated with the automated system. At one point on the belt, a barcode reader reads the barcode displayed on the patient-specific box or container and communicates the patient's identification to the computer. The computer will then retrieve the patient's medication needs from the fill list, and determine the corresponding coordinates for each medication by accessing the database.

The computer can then guide the picking means to select the desired unit dose medications and deposit them in the patient-specific boxes or containers. In particular, the picking means, which also includes a barcode reader, moves to the designated location of a particular medication, as instructed by the computer, scans the barcode displayed on the package containing the medication to identify the medication contained in the package, and provides the identity to the computer.

After the computer confirms that the correct unit dose medication is contained in the package, the picking means will remove the package from the storage area (e.g., using a vacuum generator to produce suction to pull the package off the rod, or other holding means, and hold the package until it can be deposited) and drop it into the patient-specific container.

The process is repeated until the patient's prescription has been filled (i.e., until the patient-specific medication container contains each dose of medication to be taken by the patient in the given time period or, in the instance where the unit dose retrieved the first dose for a new patient, until that first dose has been retrieved). The conveyor belt then moves the patient-specific container to a check station where an operator can use yet another barcode reader to scan the barcode label on the patient-specific container to retrieve and display the patient's prescription, as well as to scan the barcodes on each package in the container to verify that the medications are correct.

As described above, unit dose medications dispensed robotically may be packaged into bags, boxes or a variety of other over-wraps prior to being stored in the storage area. This repackaging effort is performed for several reasons. First, the size and shape of the raw packages vary greatly; therefore, without some commonality in product shape, robotic handling becomes extremely difficult. Second, while robotic systems typically rely on barcodes to identify the products throughout the process, the majority of products originating from various manufacturers do not contain barcodes of any kind or are inconsistent with respect to the information they provide. Accordingly, in these instances, over-wrapping the unit dose with a package containing a barcode may be accomplished for identification purposes.

More recently, efforts have been made to reduce any need for repackaging since, for example, repackaging adds material costs to the final product and requires both additional technician time to perform the packaging as well as additional pharmacist time to validate the content of the package against the description on the label. In addition, repacking by a hospital, or similar institution, shortens the expiration date of the repackaged item based on United States Pharmacopeia/National Formulary (USP/NF) repackaging standards. Moreover, since efforts are being made to ensure that all human drug products have a barcode on the smallest container or package distributed which, in many instances, is the unit dose medication, each unit dose on a unit dose blister card will have a barcode thereon. This includes all human prescription drug products and over-the-counter drugs that are dispensed pursuant to an order in the hospital. The barcode must contain, at a minimum, a National Drug Code (NDC) in a linear barcode, in the Uniform Code Council (UCC) or Health Industry Business Communications Council (HIBCC) format. Following the effective date of this mandate, assuming that the unit dose medications are the smallest container or package used, all unit dose medications will contain barcodes that can be used by robotic dispensing systems, thus eliminating the need to overwrap or repackage merely for identification purposes.

However, even though improvements may be achieved by enhancing the utility of an automated dispensing system in relation to eliminating repackaging or over-wrapping operations, such systems still require a fair amount of manual intervention to prepare the medications for automated dispensing. Additionally, there is no standard shape or configuration for unit dose blister cards, so automatic dispensing of unit doses was a challenge. This challenge was initially met by U.S. patent application Ser. No. 11/382,605, filed May 10, 2006, which provided a robotic device capable of dispensing unit dose blisters automatically. However, a requirement still remained for each of the unit dose blisters to be singulated manually. For example, a technician must typically undertake the tedious task of manual separation of each single unit dose blister for singulation and placement of such unit dose blisters, oriented bar code up, into a dedicated tray cavity. In some cases, technicians may be required to singulate up to three to four thousand doses per day (or more). Accordingly, it may be desirable to provide a mechanism by which to automatically singulate unit doses on a blister card.

BRIEF SUMMARY OF THE INVENTION

In general, exemplary embodiments of the present invention provide improvements relating to, among other things, providing a mechanism by which to singulate individual unit doses of a blister card or otherwise cut the blister card. In particular, embodiments of the present invention may enable efficient cutting of a blister card using an apparatus for sensing conditions and arranging the cutting blade appropriately prior to effectuating cutting. The blister card may then be reliably and automatically cut so that the blister card may be cut without increasing the risk of penetrating the seal on any of the unit dose blisters.

In particular, according to one example embodiment, an apparatus for facilitating cutting of unit dose blisters from a blister card is provided. The apparatus may include a platform, a clamp, a blade and a sensor. The blister card may be positionable on the platform for cutting. The clamp may be positionable to hold a portion of the blister card in contact with the platform for cutting when the clamp is seated. The clamp may be operatively coupled to a guillotine head. The blade may also be operatively coupled to the guillotine head. The guillotine head may be configured to move the blade through a range of motion that intersects a plane of the platform. The sensor may be positioned to detect a seating status of the clamp to enable control of movement of the guillotine head based on the seating status.

In another exemplary embodiment, a method for facilitating cutting of unit dose blisters from a blister card is provided. The method may include moving a clamp into contact with a portion of the blister card to press the blister card into contact with a platform, determining a seating state of the clamp with a sensor, and enabling cutting of the blister card via a blade in slidable contact with the cutting base based on the seating state.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 7A:
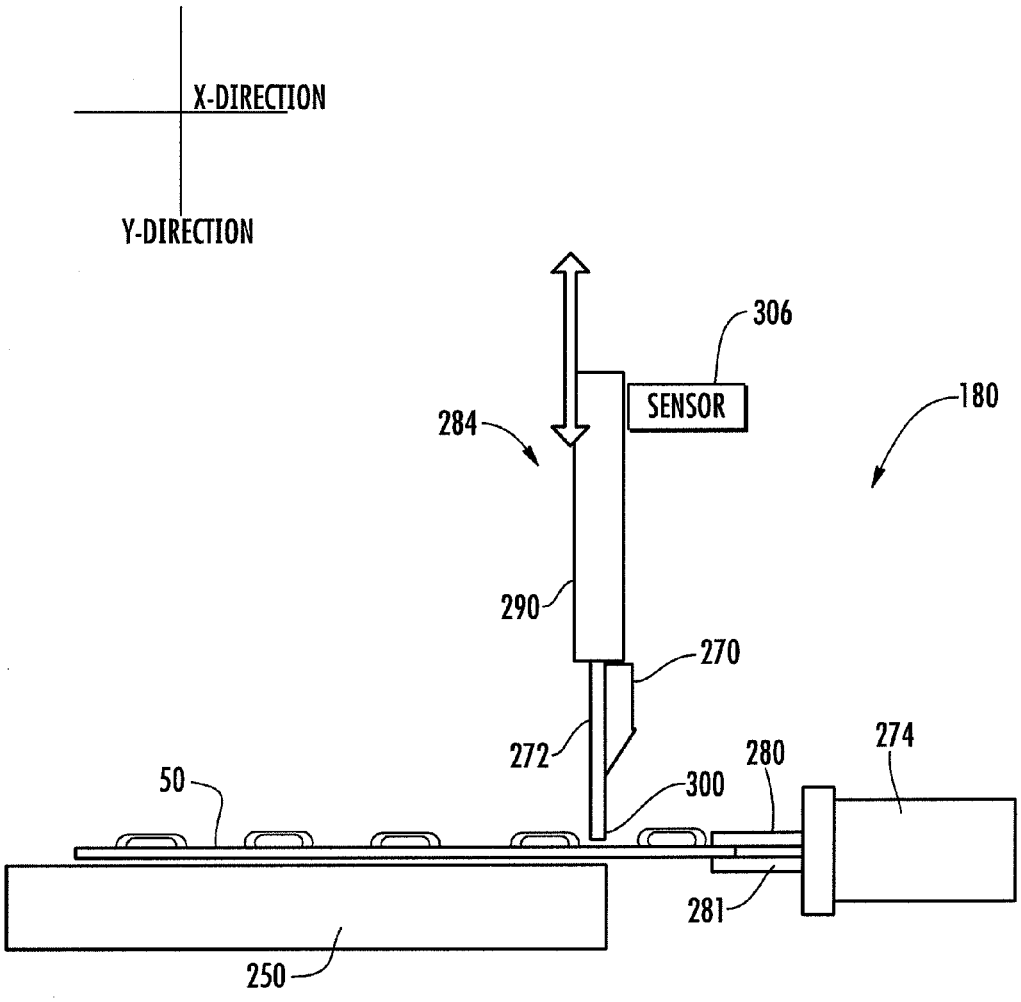
Figure 7B:
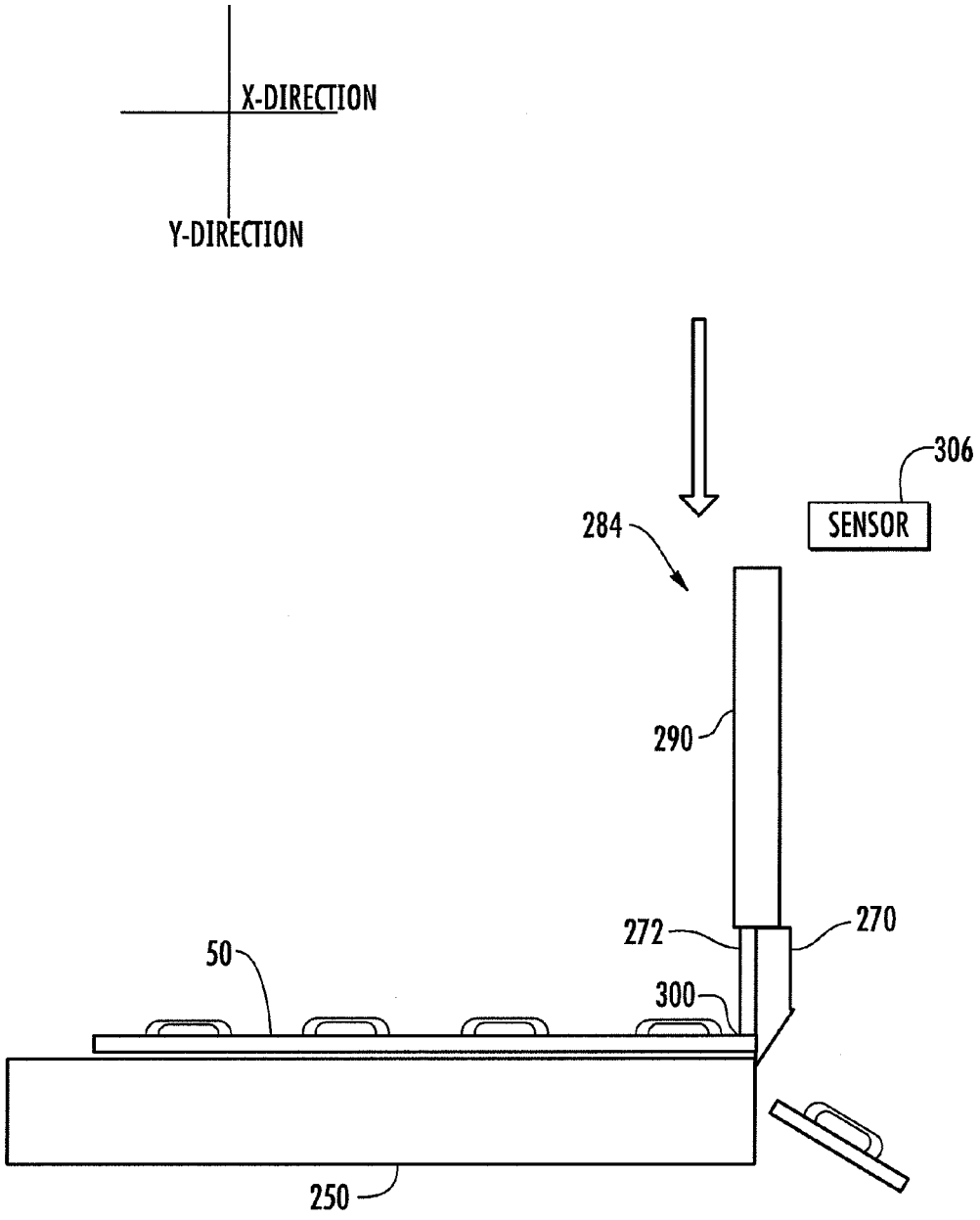
Figure 7C:
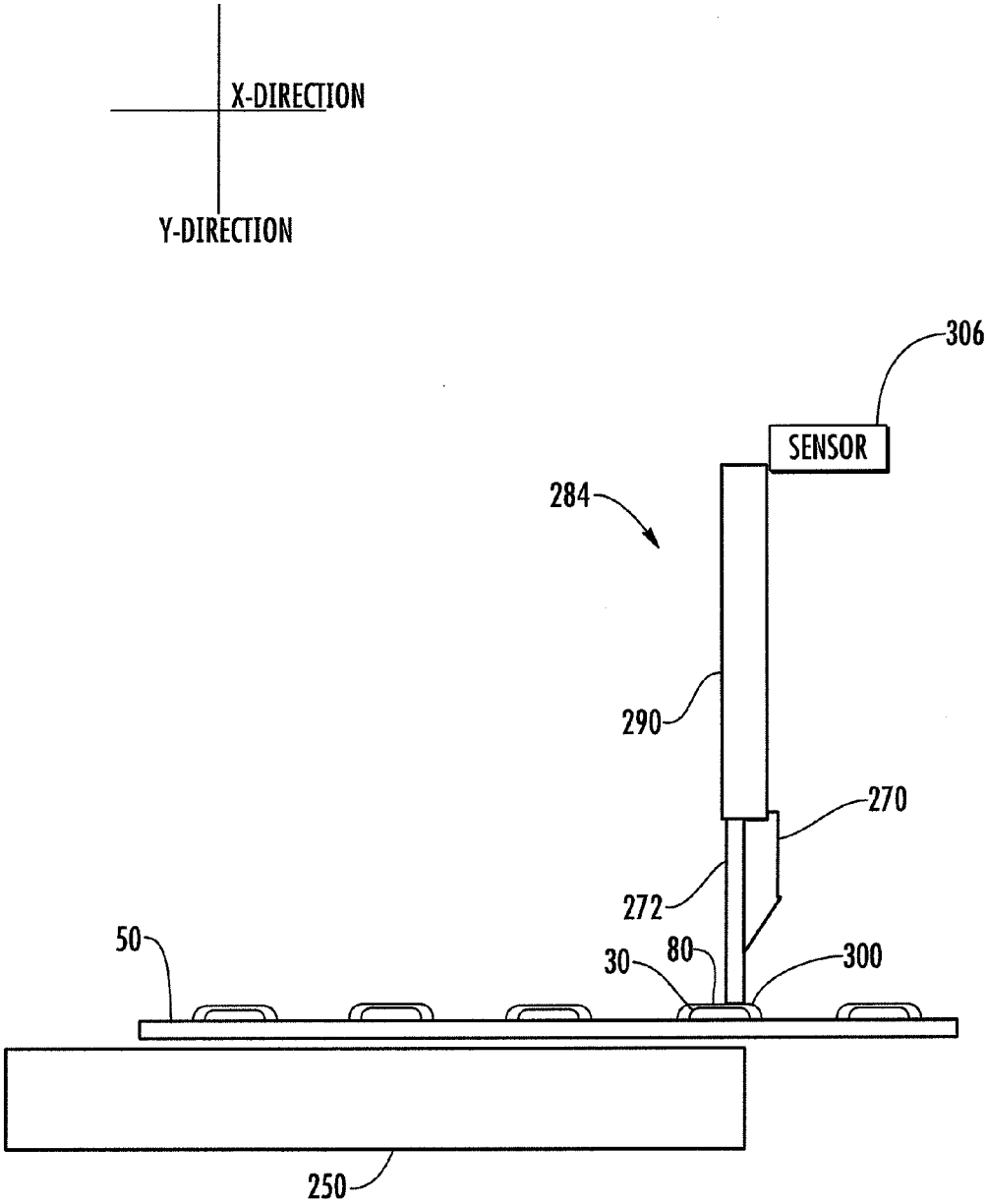
Figure 8A:
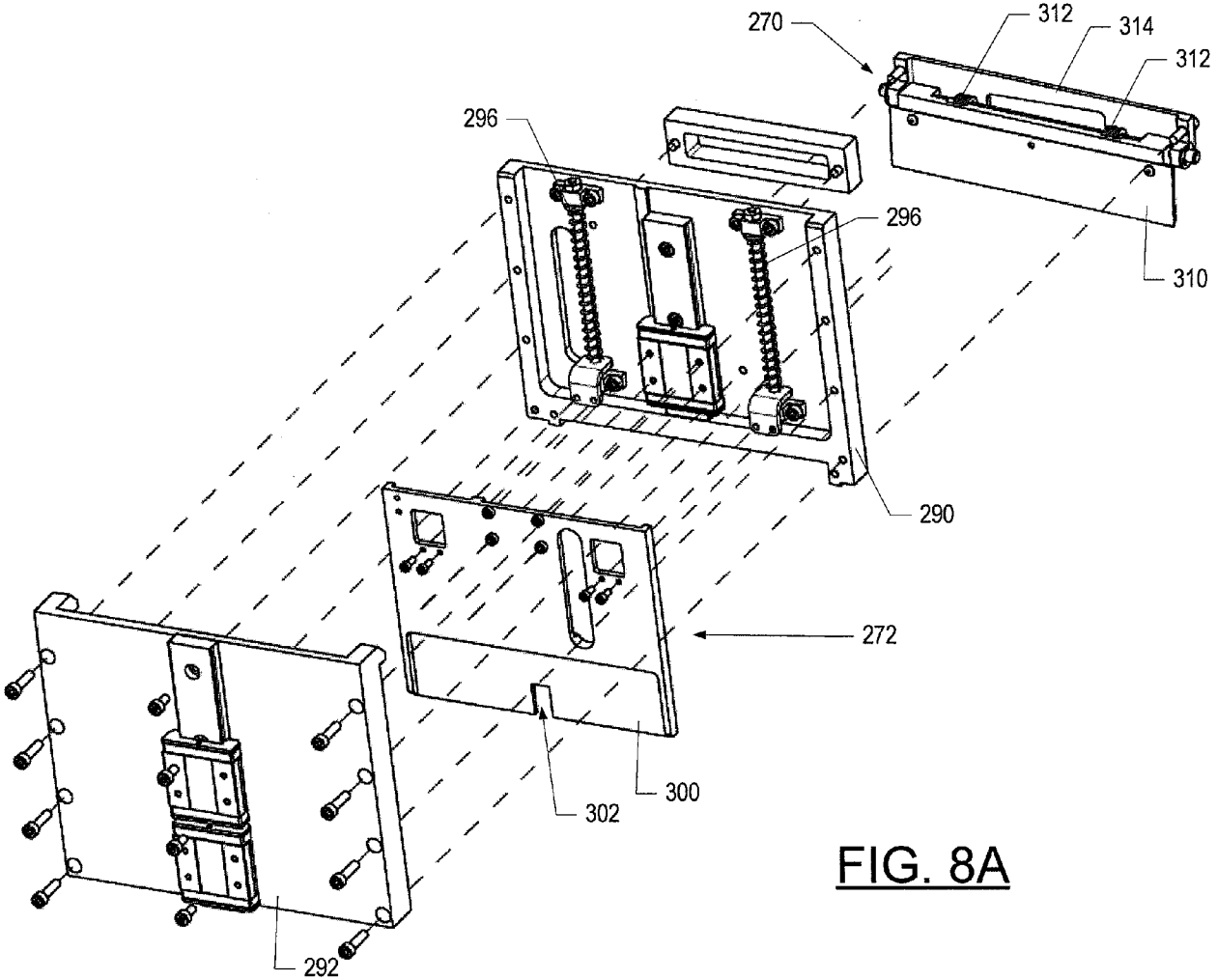
Figure 8B:
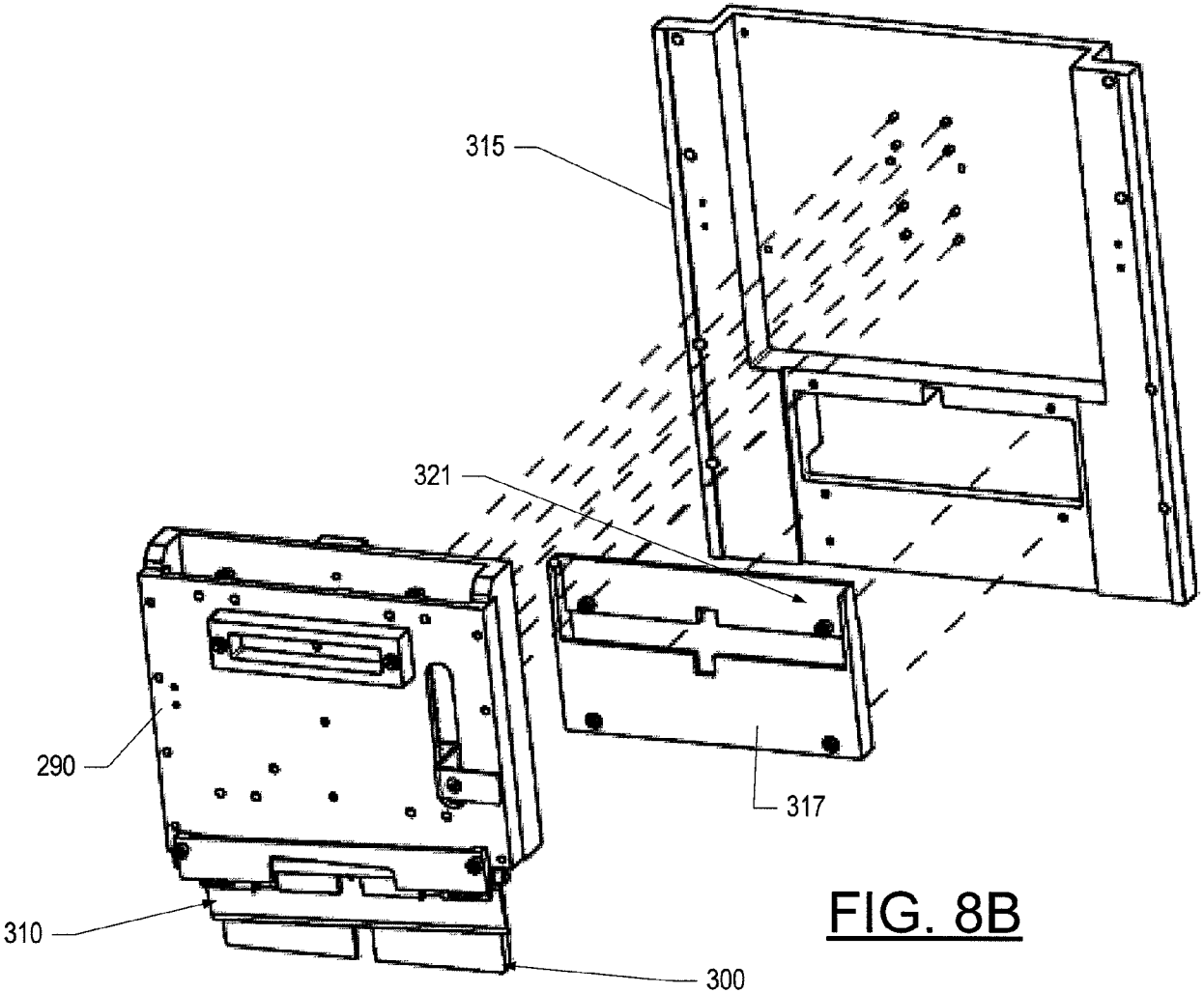
Figure 9A:
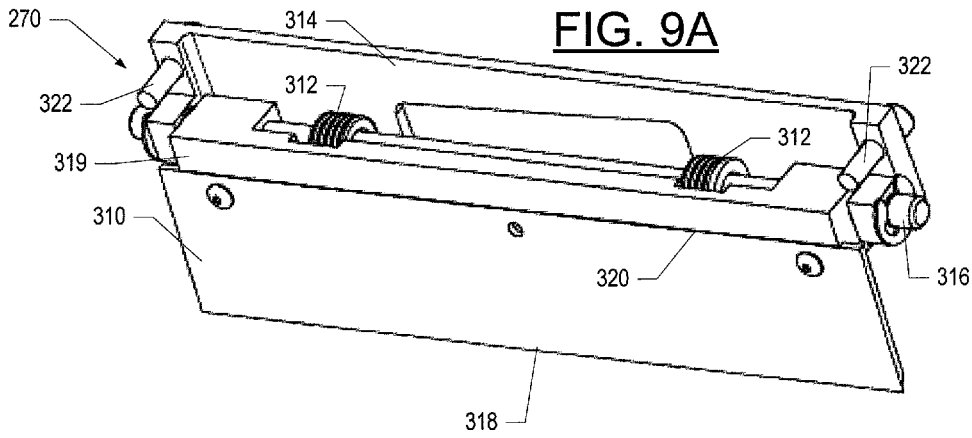
Figure 9B:
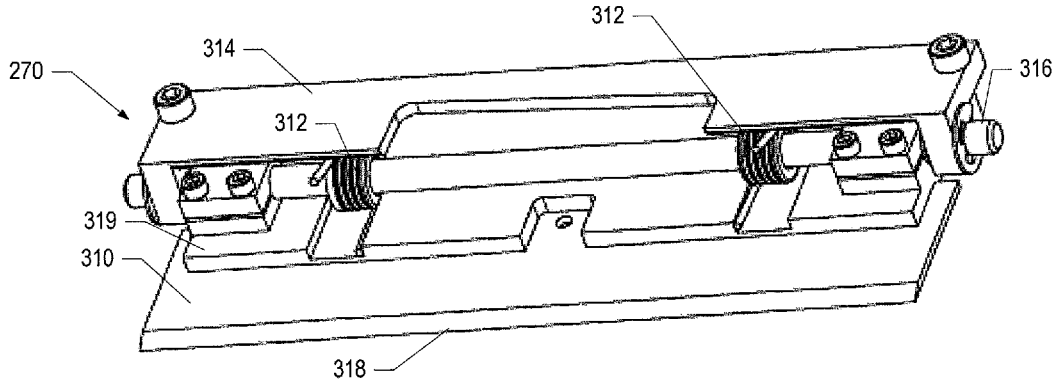
Figure 10:
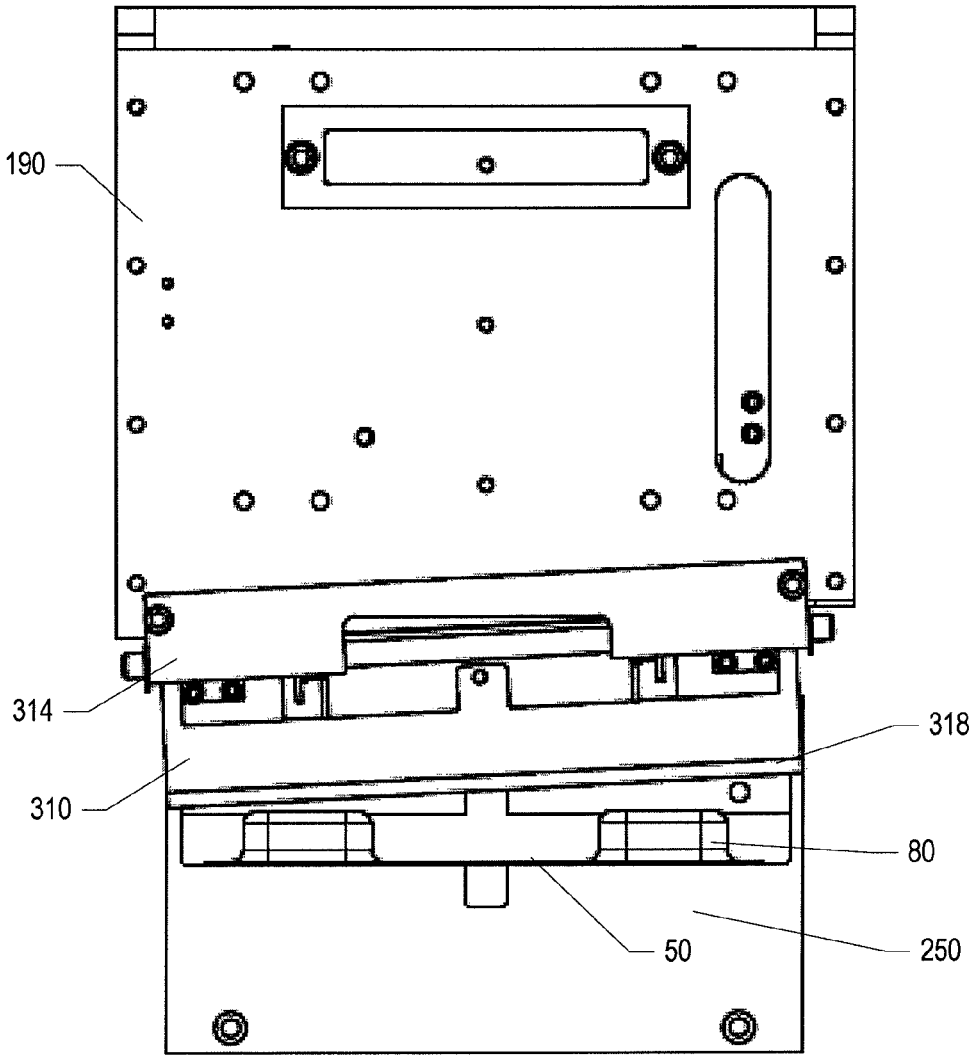
Figure 11:
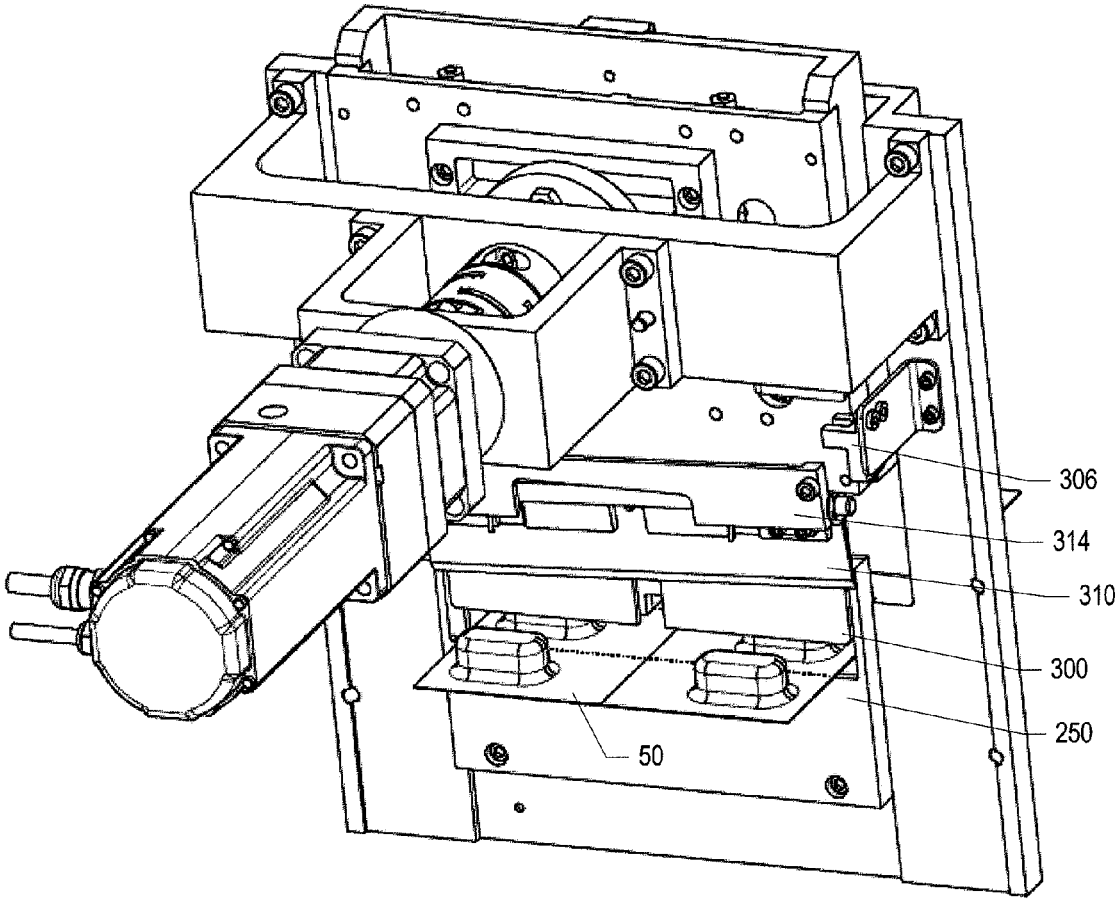
Figure 12:
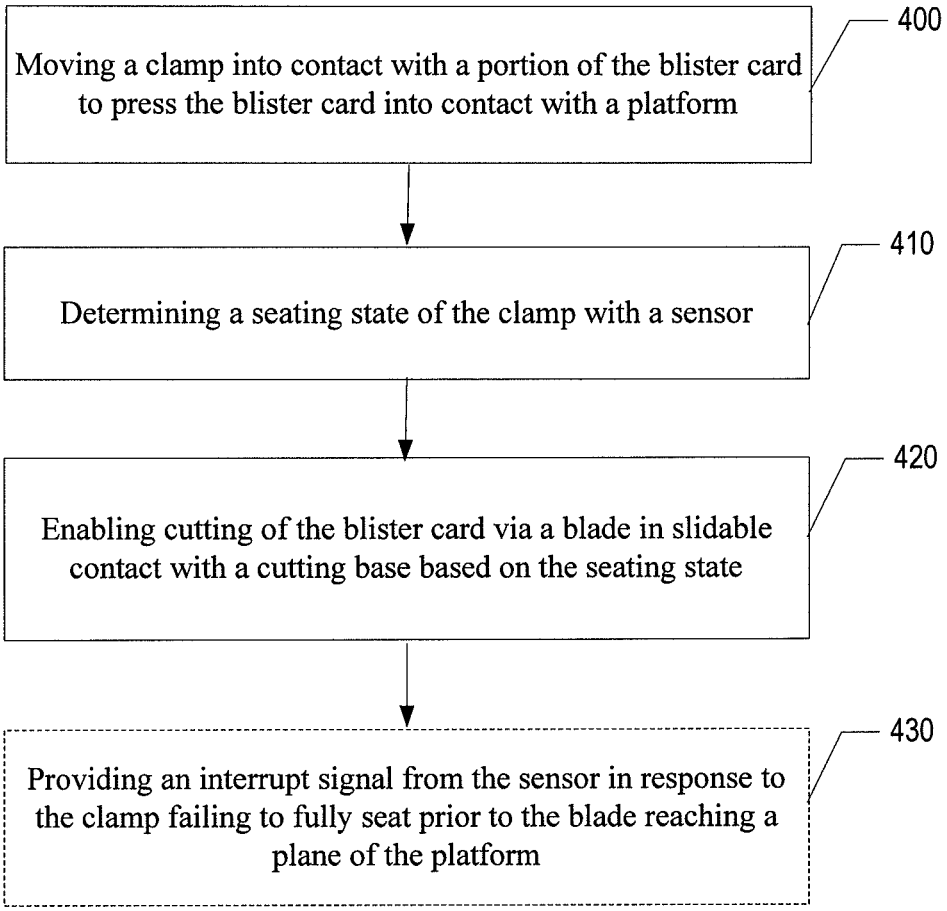

FIG. 7, which includes FIGS. 7A, 7B and 7C, shows a side view of a blister card cutter in various stages of operation according to an exemplary embodiment of the present invention;

FIG. 8, which includes FIGS. 8A and 8B, illustrates exploded perspective views of a cutting assembly according to an exemplary embodiment of the present invention;

FIG. 9, which includes FIGS. 9A and 9B, illustrates perspective views of a cutting device according to an exemplary embodiment of the present invention;

FIG. 10 illustrates a front view of the cutting device as mounted on a guillotine head according to an exemplary embodiment of the present invention;

FIG. 11 illustrates a perspective view of a blister singulator according to an exemplary embodiment of the present invention; and FIG. 12 is a flow chart illustrating a method for facilitating cutting of a unit dose blister from a blister card in accordance with an exemplary embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

In general, exemplary embodiments of the present invention provide a mechanism by which unit dose blisters may be separated either automatically or with minimal manual assistance. Moreover, embodiments of the present invention may provide a mechanism by which to accurately and reliably cut blister cards to separate each unit dose blister in a manner that guards against inadvertent cutting of the pills of each blister card or the sealed containment volumes that hold the pills. As such, some example embodiments relate to a clamp to hold a blister card being cut and prevent cutting of pills and corresponding containment volumes while a blade cuts the blister card to singulate unit dose blisters. Some embodiments may also relate to a self aligned blade that maintains its position relative to the cutting base to provide a relatively clean and consistent cut. Accordingly, singulation may be accomplished with respect to unit dose blisters on blister cards having various different shapes and/or configurations in a manner that reduces the likelihood of cutting into the seal around each unit dose blister or the barcode or human readable text that identifies the medication in the unit dose blister. For example, the blister card itself may experience alignment irregularities that place the perforations (and therefore also the sealed portions of each unit dose blister on the blister card) in positions that are not consistent relative to the edges of the blister cards when compared to other blister cards among a plurality of blister cards for different or even in some cases the same type of product. Thus, embodiments of the present invention may provide a mechanism for singulating unit dose packages in their natural, raw state in a repeatable fashion so that they can be selectively retrieved and delivered, for example by one of the automatic retrieval systems discussed above (e.g., the ROBOT-Rx® system or a robot system able to handle blister dispensing such as that described in U.S. patent application Ser. No. 11/382,605, filed May 10, 2006).

Figure 1:
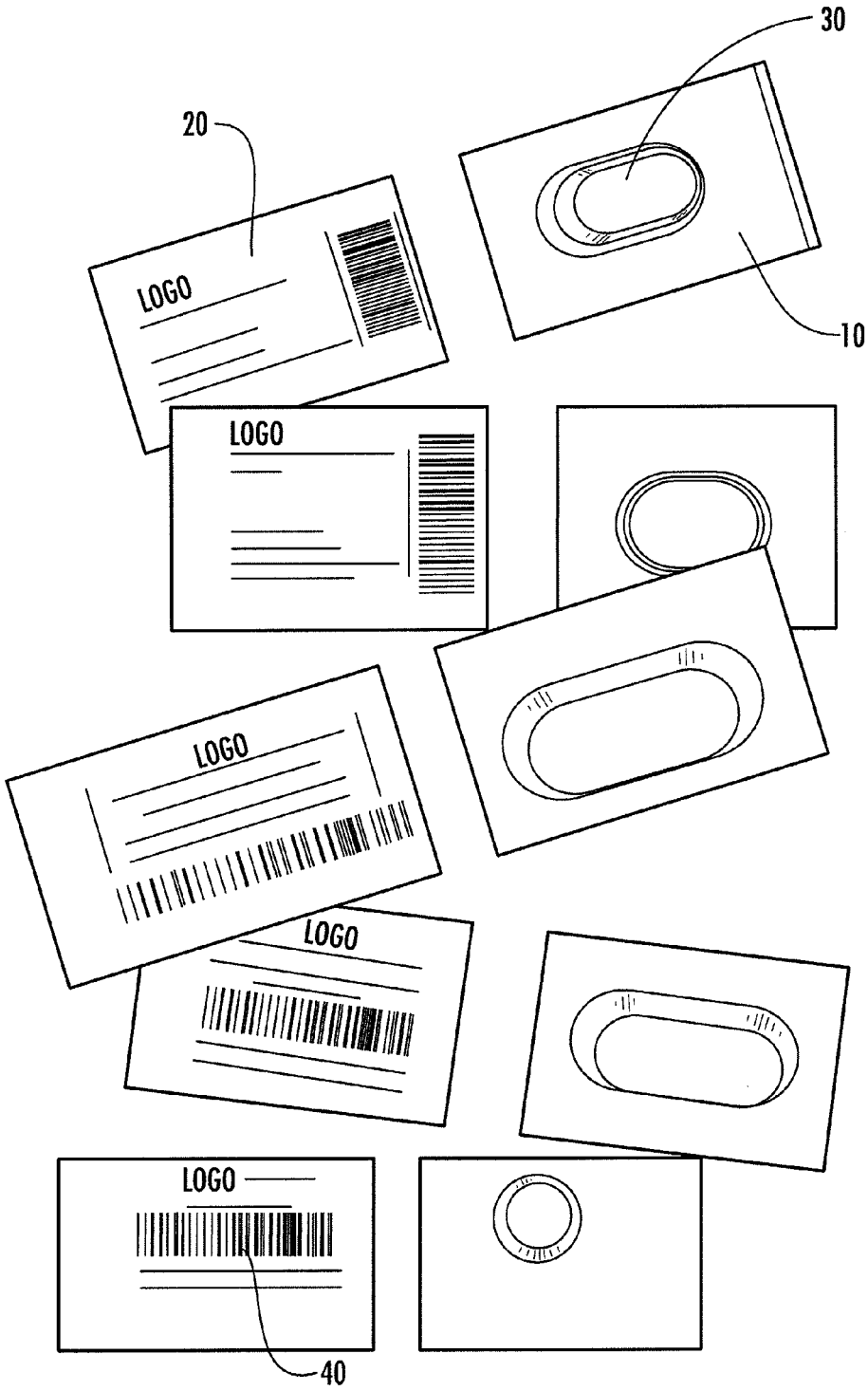
FIG. 1 illustrates several unit dose blisters.

The term "unit dose blister" refers to a unit dose medication, or one or more oral solids of the same or different strength, form or type, that has been sealed in a package, such as a vinyl and foil package in which the vinyl conforms to the shape of the medication. The vinyl is typically sealed to a foil that offers a flat surface with medication information printed on the opposite side from the vinyl cavity. FIG. 1 illustrates several examples of unit dose blisters. As shown, the unit dose blister may include a support panel having opposed first 10 and second 20 sides, wherein the unit dose medication 30 (i.e., the one or more oral solids) is positioned proximate the first side 10 of the support panel, and an identification code 40 (e.g., a barcode, radio frequency identification (RFID) tag, or simple text including any number and combination of alphanumeric characters) including information identifying the unit dose medication 30 is displayed on the second side 20 of the support panel.

Figure 2:
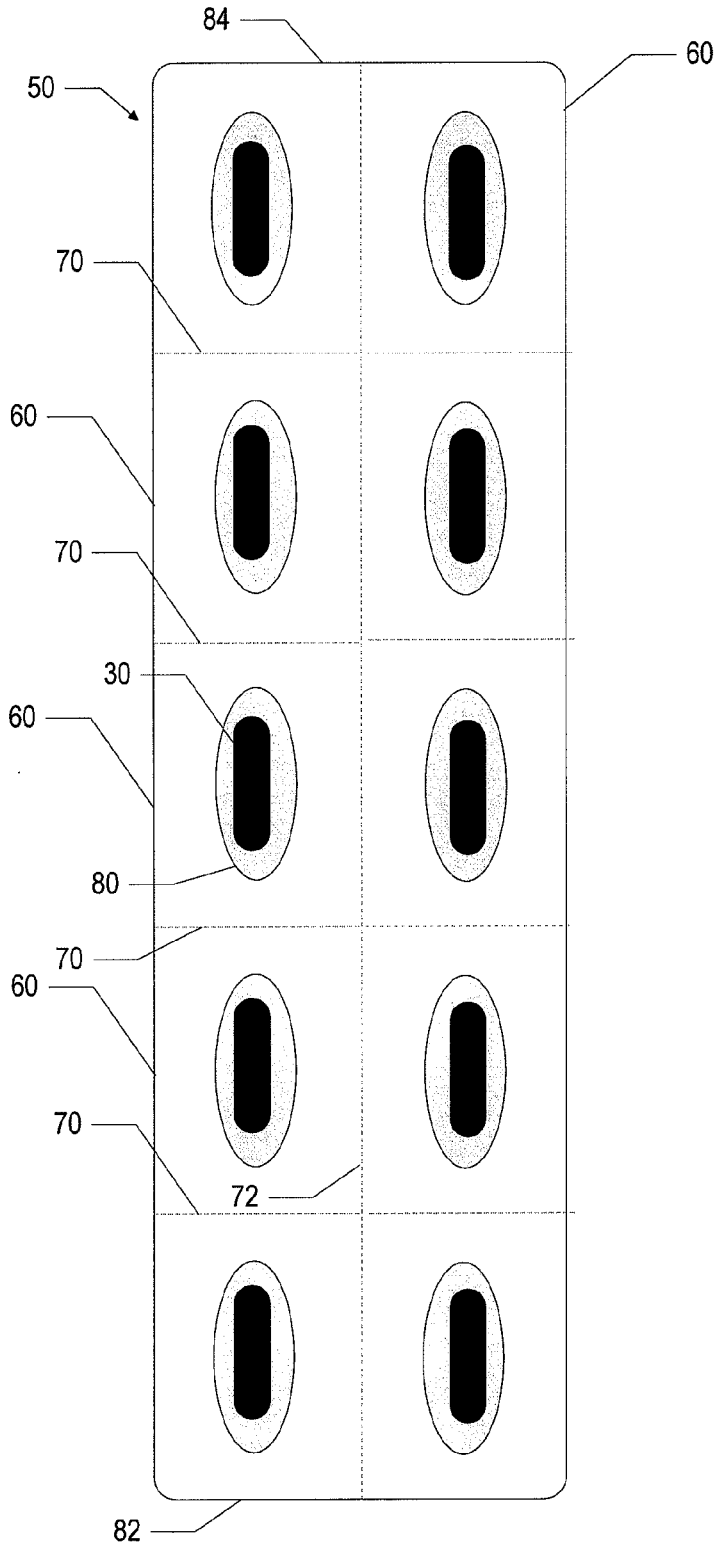
FIG. 2 illustrates several unit dose blisters within a blister card.

When unit dose medications are packaged into a blister, they are typically packaged with several medications per blister card. Thus, there are a corresponding number of equally-spaced vinyl formed cavities per blister card. These cavities are typically separated by a perforation. During formation of a blister card, several manufacturing stations are encountered, but there is no correlation between the handling techniques employed at each station. Accordingly, a blister card that passes through a station for forming a cavity, labeling of the blister, punching of the blister receptacle, punching out of the card, etc., may not be handled in the same manner at each station as the previous or subsequent blister card. Accordingly, inconsistencies may be created between different blister cards. A singulated blister is one that has been separated from a blister card typically along its perforation. FIG. 2 illustrates a diagram of a blister card 50 according to an exemplary embodiment. As shown in FIG. 2, the blister card 50 may include a plurality of unit dose blisters 60 separated by perforations 70 and 72. The perforations 70 may extend between each adjacent unit dose blister 60 in substantially a straight line from one end of the blister card 50 to an opposite end of the blister card 50 in both horizontal and vertical directions. As such, one set of perforations (e.g., extending in a substantially horizontal direction) may be intersected by another set of perforations (e.g., extending in a substantially vertical direction) at approximately a right angle. Each unit dose blister 60 may include one unit dose medication 30 disposed in a vinyl cavity 80. The vinyl cavity 80 of each unit dose blister 60 may be approximately centrally located with respect to edges of the corresponding unit dose blister 60 as defined by the perforations 70 and/or blister card 50 edges that are immediately adjacent to the corresponding unit dose blister 60.

As indicated above, the distance from the vinyl cavity 80 to the edge of the blister card 50 may vary from card to card. However, the distance between perforations 70 may be consistent within a given blister card. Thus, it may be expected that a distance between perforations 70 is relatively constant along a given direction. FIG. 2 shows a common 2×5 arrangement for the blister card 50 having only one perforation roughly approximating the centerline of the longitudinal axis of the blister card 50 (e.g., a centerline perforation 72). However, for embodiments with more than two unit dose blisters in the horizontal direction, the horizontal distances between the perforations would be expected to be the same, while the distance between the last perforation on each of the right and left sides of the blister card and the corresponding right and left edges of the blister card may not be the same.

The blister card 50 may include a first edge 82 and a second edge 84, respectively, positioned at opposite longitudinal ends of the blister card 50. According to some embodiments, the location of the perforations and/or the edges of the blister card 50 may be used as a reference for which to make cuts of the blister card 50 to effectuate unit dose blister singulation. As such, the blister card 50 may be manually and/or automatically positioned (e.g., based on edge and/or perforation location) in order to align the blister card 50 for cutting. Thereafter, the blister card 50 may be cut (e.g., along or near the perforations) in order to singulate unit does blisters 60.

As one of ordinary skill in the art will recognize, while reference is made throughout to unit dose blisters of the form described above, these unit dose blisters provide just one form in which unit dose medications may be packaged. Use of unit dose blisters in the description of exemplary embodiments included herein should not, therefore, be taken as limiting the scope of the present invention to use with such unit dose packages. In contrast, other unit dose packages may similarly be used in connection with exemplary embodiments without departing from the spirit and scope of the present invention. Furthermore, it should be noted that although the blister card 50 of FIG. 2 shows a 2×5 unit dose configuration, other configurations are also possible including a 2×10 configuration, configurations with more than two in the horizontal direction (e.g., a 4×4 configuration), and any other configuration.

Figure 3:
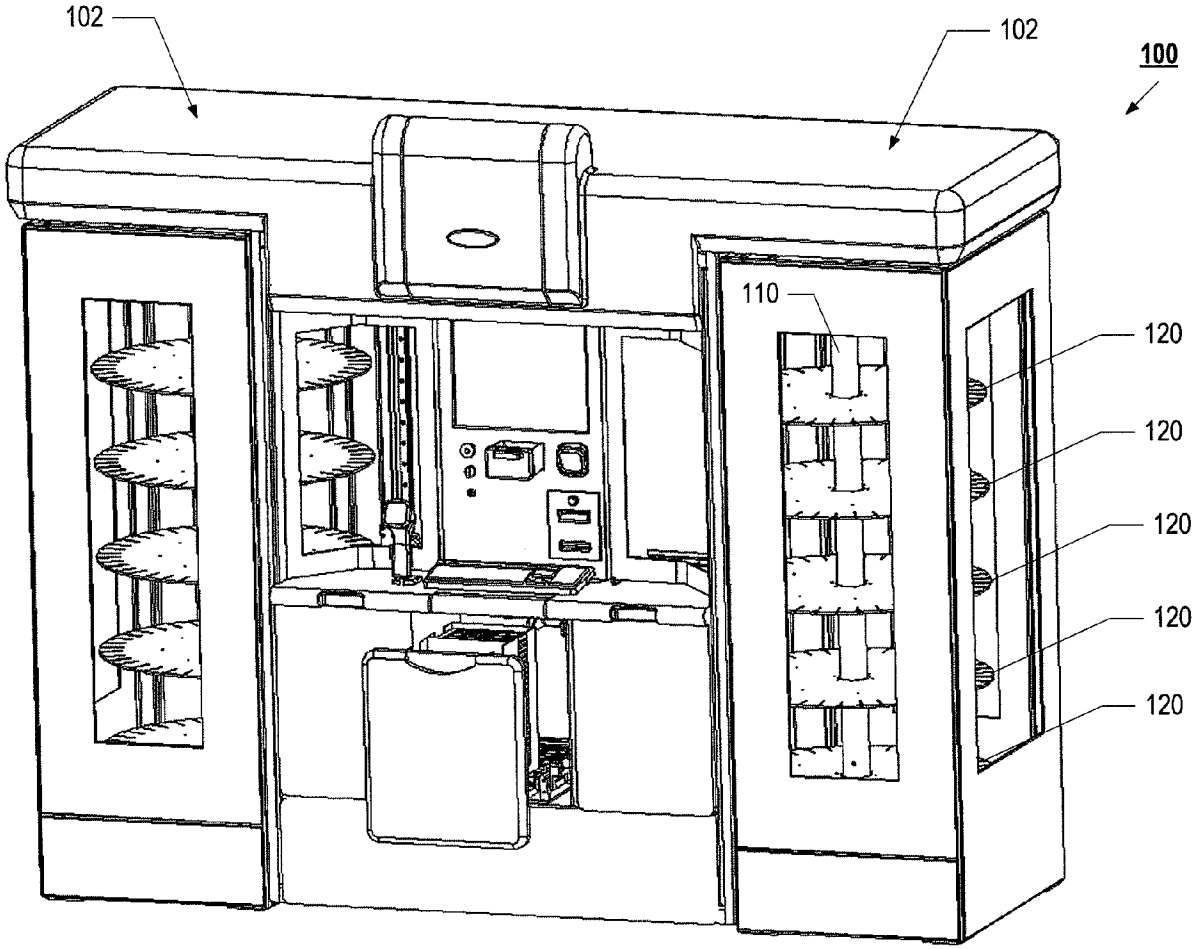
FIGS. 3 and 4 illustrate a storage, retrieval and delivery system in accordance with exemplary embodiments of the present invention.
Figure 4:
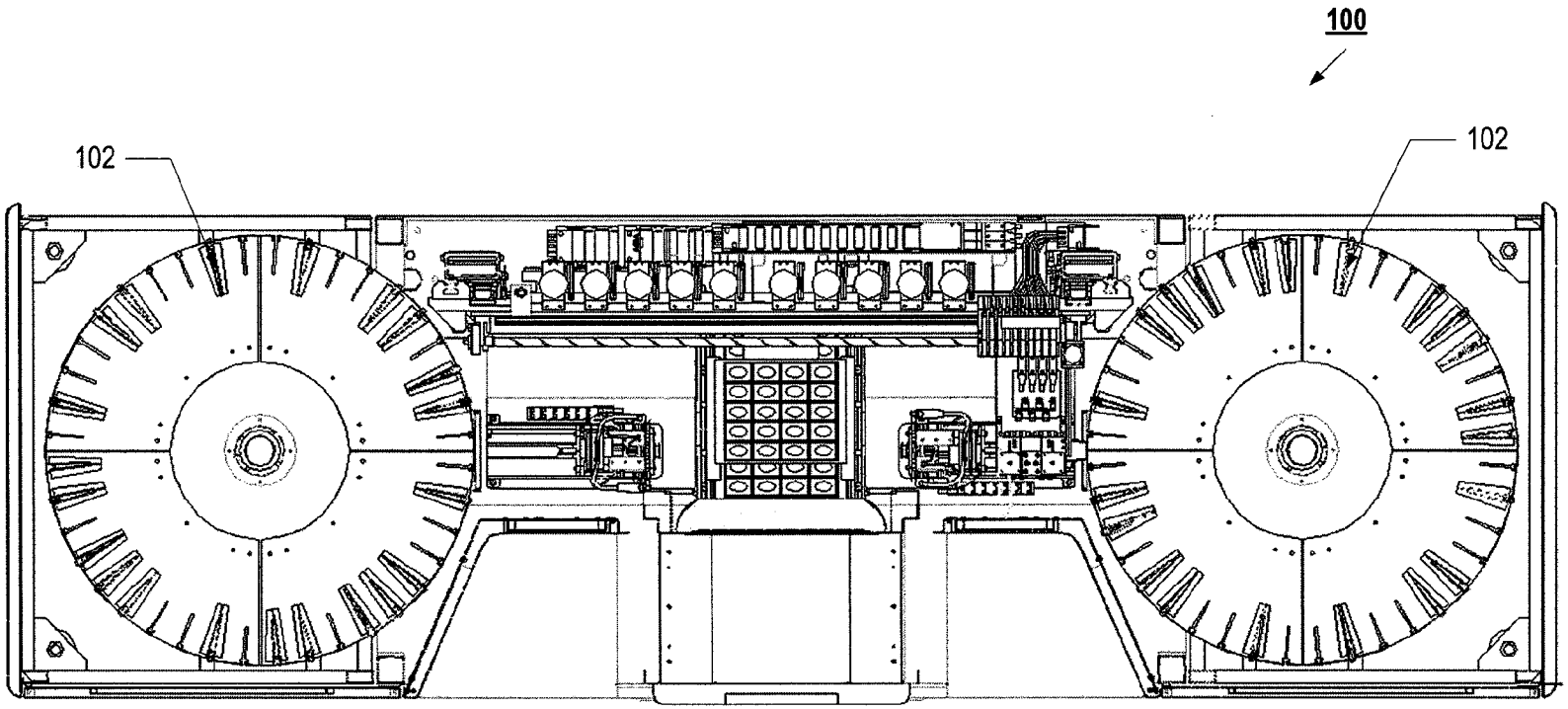

Reference is now made to FIGS. 3 and 4, which illustrate one example of a storage, retrieval and dispensing system 100, in which exemplary embodiments of the present invention may be implemented. As one of ordinary skill in the art will recognize, the system 100 illustrated and described herein is just one manner in which the unit dose packages, or packages containing unit dose medications (e.g., unit dose blisters) may be handled in their natural or raw state (i.e. not over-wrapped or repackaged) in accordance with exemplary embodiments of the present invention. The system 100 of FIGS. 3 and 4 is provided for exemplary purposes only and should not be taken as limiting the scope of the invention in any way, since other systems may likewise be implemented without departing from the spirit and scope of the present invention.

Figure 5:
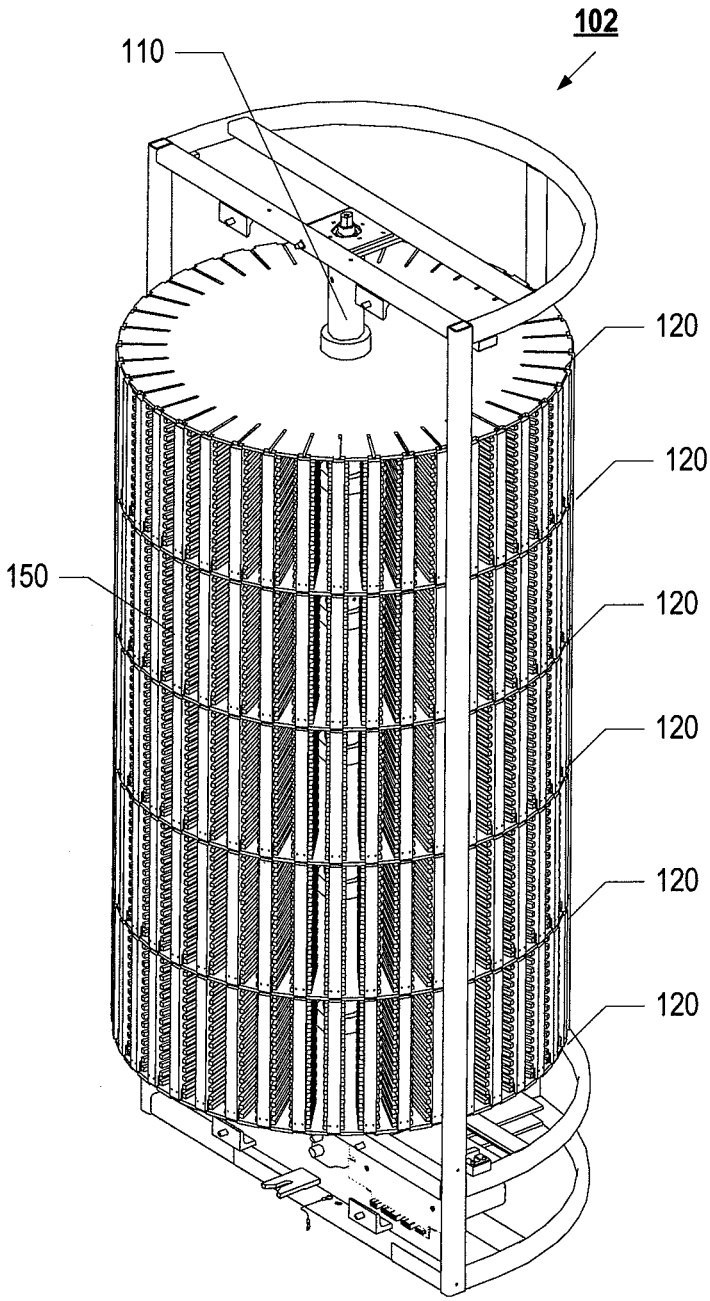
FIG. 5 illustrates a storage system in accordance with exemplary embodiments of the present invention.

The system 100 of exemplary embodiments may include a means for storing a plurality of unit dose blisters of various shapes and sizes, referred to herein as a "storage system" 102. As shown, the storage system 102 of one exemplary embodiment, which is also illustrated in FIG. 5, may be in the form of one or more carousels capable of rotating around a rod or pole 110 extending upward through the center of the carousel. While not shown, the storage system may, alternatively, comprise a linear track that is stationary and essentially resembles a plurality of pigeon holes or mail slots each including a unit dose package mount (e.g., a unit dose blister mount), which is described in detail below. Returning to FIGS. 3 and 4, the rod or pole 110 may be configured to support a plurality of circular panels 120 positioned at some distance from one another, wherein each panel is, in turn, configured to support a plurality of unit dose package mounts (e.g., unit dose blister mounts) (not shown in FIG. 3 or 5), via a plurality of package mount receptacles 150 (e.g., blister mount receptacles—shown in FIG. 5).

In this regard, the blister mount receptacles 150 of one embodiment shown in FIG. 5 extend between adjacent panels 120 so as to define a plurality of wedge-shaped cavities. While the panels 120 could be spaced and the unit dose blister mounts sized such that each wedge-shaped cavity defined by the blister mount receptacles 150 received a single unit dose blister mount, the storage system 102 of the illustrated embodiment is capable of storing a plurality of unit dose blister mounts within each wedge-shaped cavity. In this regard, the blister mount receptacles 150 can include tracks for engaging corresponding grooves or other features defined by the unit dose blister mounts such that multiple unit dose blister mounts can be inserted into a single storage location, e.g., a single wedge-shaped cavity, in an organized manner.

Figure 6:
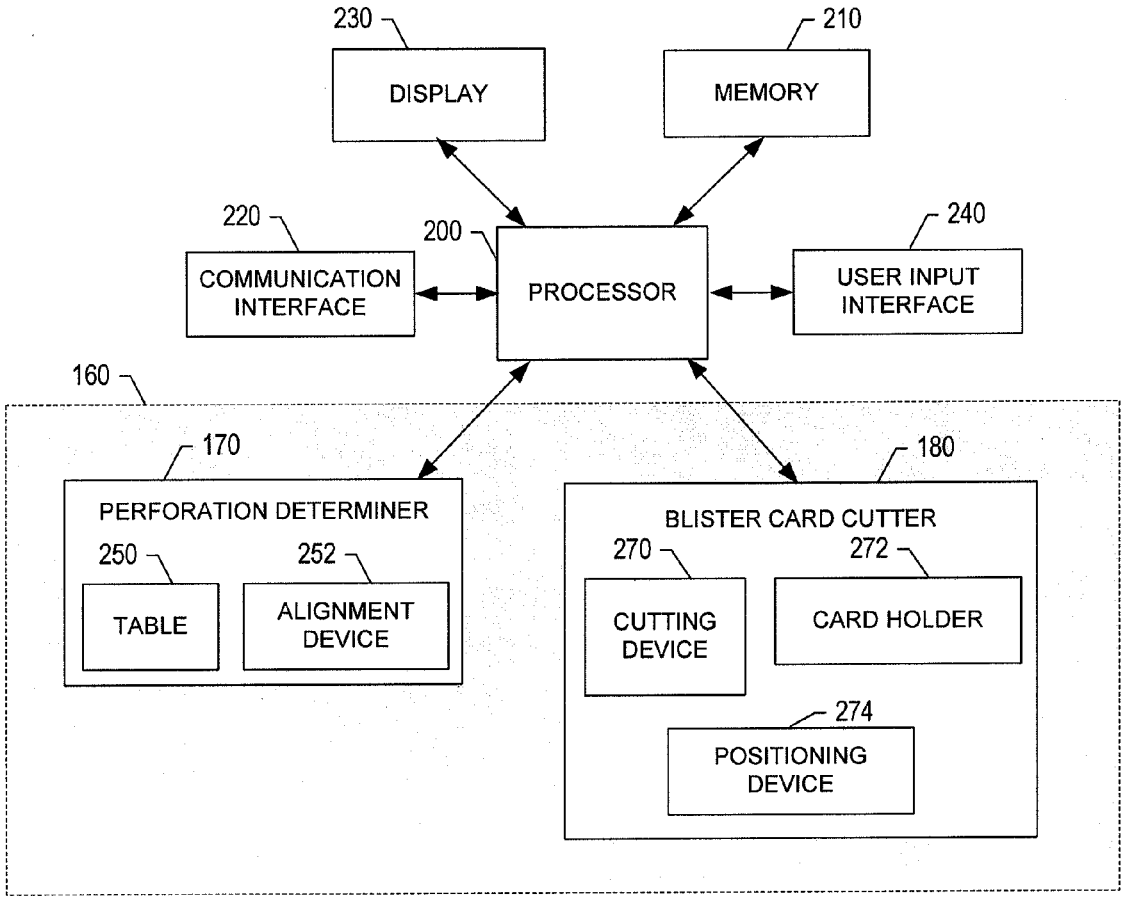
FIG. 6 illustrates a block diagram of a blister singulator according to an exemplary embodiment of the present invention.

In an exemplary embodiment, the system of FIGS. 3-5 may further include or otherwise be in operable communication with a unit dose blister singulator, an exemplary embodiment of which is shown in FIG. 6. FIG. 6 illustrates a block diagram of a blister singulator 160 according to an exemplary embodiment. The blister singulator 160 according to one exemplary embodiment may be a device comprising mechanical and electrical components configured to enable the blister singulator 160 to determine where to cut a blister card based on predetermined positioning of the blister card at corresponding identified locations in order to singulate individual unit dose blisters.

As shown in FIG. 6, the blister singulator 160 of an exemplary embodiment may include a perforation determiner 170 and a blister card cutter 180. The perforation determiner 170 and the blister card cutter 180 may each be any means or combination of means such as a device or circuitry (or combination thereof) embodied in either hardware, computer program product, or a combination of hardware and computer program product that is configured to perform the corresponding functions of the perforation determiner 170 and the blister card cutter 180, respectively, as described herein. Although a perforation determiner 170 is shown in the example of FIG. 6, the perforation determiner 170 should be appreciated as being an example of a device used for determining positioning of the blister card in general. As such, positioning criteria other than perforation location could alternatively be used in some embodiments for positioning of a blister card that is to be cut by the blister card cutter 180.

In an exemplary embodiment, one or both of the perforation determiner 170 and the blister card cutter 180 may include or otherwise operate under the control of processing circuitry. Moreover, in some embodiments the processing circuitry of FIG. 6 may also control the storage, retrieval and delivery system 100 of exemplary embodiments of the present invention. As such, the system 100 may further comprise a processor, controller, or similar processing device, capable of directing the perforation determiner 170 and the blister card cutter 180 as described herein. However, in alternative embodiments, the processing circuitry may only control the operation of the blister singulator 160.

An exemplary embodiment will now be described referring to FIG. 6, which is a block diagram of a controller, or similar processing device, capable of operating in accordance with an exemplary embodiment of the present invention. As shown, the processing circuitry may include various means for performing one or more functions in accordance with exemplary embodiments of the present invention, including those more particularly shown and described herein. It should be understood, however, that the processing circuitry, which may include a controller, or similar processing device, may include alternative means for performing one or more like functions, without departing from the spirit and scope of the present invention. As shown, the processing circuitry may include a processor 200 connected to a memory 210. In addition to the memory 210, the processor 200 may also be connected to at least one interface or other means for displaying, transmitting and/or receiving data, content or the like. In this regard, the interface(s) can include at least one communication interface 220 or other means for transmitting and/or receiving data, content or the like, as well as at least one user interface that may include a display 230 and/or a user input interface 240. The user input interface 240, in turn, may comprise any of a number of devices allowing the controller to receive data from a user, such as a keypad, a touch display, a joystick, a foot pedal, actuator, button or other input device. However, in some embodiments, the display 230, user input interface 240 and/or the communication interface 220 may be omitted.

The processor 200 may be embodied as various processing means such as a processing element, a coprocessor, a controller or various other processing devices including integrated circuits such as, for example, an ASIC (application specific integrated circuit), an FPGA (field programmable gate array), a PLC (programmable logic controller), a hardware accelerator, or the like. The processor 200 may be configured (e.g., via hardcoded instructions or via execution of software instructions) to perform or control the various functions of the processing circuitry. The memory 210 may include volatile and/or non-volatile memory, and typically stores content, data or the like. For example, the memory 210 may be non-transitory memory capable of storing content transmitted from, and/or received by, the processing circuitry. Also for example, the memory 210 may store software applications, instructions or the like for enabling the processor 200 to perform steps associated with operation of the processing circuitry in accordance with embodiments of the present invention.

In one exemplary embodiment, the memory 210 stores instructions for directing the processor 200 to control the perforation determiner 170 (or other blister card position determiner) in relation to determining perforation locations for the blister card 50. In an exemplary embodiment, in order to determine positioning information (e.g., perforation or edge location), the perforation determiner 170 may include a table 250 and an alignment device 252. However, any other automatic or manually employed devices may alternatively be employed. Meanwhile, in order to singulate each unit dose blister 60 of the blister card 50, the blister card cutter 180 may include a cutting device 270 (or blade), a card holder 272, and a positioning device 274.

In operation, the blister card 50 may be positioned on the table 250 to accurately identify (e.g., via the alignment device 252) positioning information to be used by the blister card cutter (e.g., the positioning device 274) to enable accurate cutting of the blister card 50 based on the positioning information. The positioning information may then be communicated to the processor 200, which may control the blister card cutter 180 to cut the blister card 50 at various locations (e.g., along each perforation 70 and along the centerline perforation 72) to singulate each unit dose blister 60. In this regard, the blister card cutter 180 may employ the positioning device 274 to grip the blister card 50 and position the blister card 50 relative to the cutting device 270 to initiate an initial cut along a respective one of the perforations 70. The card holder 272 may be employed to hold the blister card 50 in place during the cutting along the perforation 70 so that the as yet uncut portion of the blister card 50 is held in place while the positioning device 274 proceeds to operate on the unit dose blisters that have been separated from the blister card 50 by the cutting of the cutting device 270. In some cases, a second blade may be employed to cut along the centerline perforation 72 or a separate operation may be employed as appropriate to cut along the centerline perforation 72. As can be appreciated from FIG. 2, the cutting device 270 may make a cut along a direction that is substantially perpendicular to the longitudinal axis of the blister card 50, which may leave two unit dose blisters (or more for blister cards with other configurations) being gripped by the positioning device 274, where the two unit dose blisters are separated by the centerline perforation 72.

The positioning device 274 may then advance the two unit dose blisters to contact the second cutting device (if employed), which may be positioned to cut along a direction substantially parallel to the longitudinal axis of the blister card 50 in order to cut along the centerline perforation 72. After cutting along the centerline perforation 72, the two unit dose blisters may be separated into two singulated unit dose blisters 60. Alternatively, the positioning device may advance the cut unit dose blisters to another location or allow the cut unit dose blisters to fall into a chute or other receptacle for further processing.

In an exemplary embodiment, the positioning device 274 may be configured to then grip the remainder of the blister card 50 (e.g., disengage the cut blister card portion and move to grip the remainder of the blister card 50) and, subsequent to a release of the card holder 272, advance the remainder of the blister card 50 such that the next perforation 70 is enabled to be cut by the cutting device 270 in the same manner described above. In some cases, the next perforation 70 may be detected using some type of perforation detection means. However, in an exemplary embodiment, the processor 200 may determine the location of each perforation 70 based on other position information. In this regard, for example, the processor 200 may receive information (e.g., via the user input interface 240) regarding the configuration of the blister card 50. As such, the processor 200 may be made aware of the number of perforations 70 that lie perpendicular to the longitudinal axis of the blister card 50 (e.g., four perforations for a 2×5 blister card). Knowing that a total of four perforations are positioned equidistant from each other, the processor 200 may be enabled to determine the locations of each intermediate perforation. Thus, the processor 200 may be configured to determine the distance from one cut made by the cutting device 270 to the next in order to accurately cut the blister card 50 along each perforation that lies perpendicular to the longitudinal axis of the blister card 50.

FIG. 7, which includes FIGS. 7A to 7C, illustrates a side view of several components of the blister card cutter 180 and others that interact with the blister card cutter 180 to affect cutting of the blister card 50 according to an exemplary embodiment. As shown in FIG. 7A, the positioning device 274 may include a mechanical arm such as an articulated robot arm. The positioning device 274 may also include a gripper (e.g., as indicated by upper arm 280 and lower arm 281). In some embodiments, the gripper may be configured to engage the blister card 50 and disengage the blister card 50 responsive to control from the processor 200. In doing so, for example, the upper arm 280 and the lower arm 281 may be configured to move toward each other in the y-direction to pinch the blister card 50 therebetween. To disengage the blister card 50, the upper arm 280 and the lower arm 281 may be configured to move away from each other in the y-direction to release the blister card 50. The positioning device 274 may also be configured to move in the x-direction (e.g., in a direction toward the table 250) to engage the blister card 50 and then, after gripping the blister card 50, move away from the table 250 in order to position the blister card 50 for cutting.

In some embodiments, after cutting, the positioning device 274 may move further away from the table 250 before releasing the cut portion of the blister card 50, or may immediately release the cut portion of the blister card 50 without further movement away from the table 250. Following release of the cut portion of the blister card 50, the positioning device 274 may again advance toward the table 250 to grip a next portion of the blister card 50 for cutting or at least advancing through the blister card cutter 180 until the blister card 50 is passed completely through the blister card cutter 180 at which time a next blister card may be engaged to repeat the process described above. In other embodiments, the positioning device 274 may release the blister card 50 responsive to seating of the card holder 272 as described in greater detail below. Thus, in some cases, as, shown in the example of FIG. 7B, when a portion of the blister card 50 is cut, the cut portions may be allowed to simply fall into a chute, onto a conveyer, or some other mechanism for holding or transporting cut stock.

In some alternative embodiments, instead of a robot arm, the positioning device 274 may include a roller assembly configured to engage a top, bottom and/or side portion of the blister card 50 on the table 250 in order to advance the blister card 50 relative to a surface of the table 250. A conveyer belt may alternatively be used in other cases. Still other mechanisms for movement of the blister card 50 may also be employed for the positioning device 274 in other alternative exemplary embodiments.

In an exemplary embodiment, the cutting device 270 and the card holder 272 may each be mounted to a cutting assembly 284 that may further include a guillotine head 290. The cutting assembly 284 may be moved downward (e.g., toward the table 250 in the y-direction) to effectuate clamping of the blister card 50 by the card holder 272 and subsequent cutting of the blister card 50 by the cutting device 270. The cutting assembly 284 may then be moved upward (e.g., away from the table 250 in the y-direction) to reset the cutting assembly for a next cutting operation. In some embodiments, the cutting assembly 284 may be mounted to move linearly up and down in the y-direction to drive force from an electric or other drive motor. In some cases, the drive motor may be coupled to a cam to convert the rotational force produced by the drive motor to a linear force to move the cutting assembly 284 up and down in the y-direction.

FIG. 8, which includes FIGS. 8A and 8B, illustrates exploded perspective views of the cutting assembly 284 according to an exemplary embodiment. Referring now to FIGS. 7 and 8, the cutting assembly 284 may include both the cutting device 270 and the card holder 272 mounted to the guillotine head 290. The guillotine head 290 may include a cover 292 configured to enclose at least a portion of the card holder 272 when the cover 292 is attached to the cutting assembly 284. In an exemplary embodiment, the guillotine head 290 may, when coupled to the cover 292, form a movement channel within which the card holder 272 may move. The guillotine head 290 may include one or more compression springs 296 to which the card holder 272 may be mounted. In some embodiments, the compression springs 296 could be replaced by any elastic/deformable element that returns to its original state after the load is removed (e.g., an extension spring, rubber, a bumper, a gas cylinder, etc.). The guillotine head 290 may also be mounted to the cutting device 270. However, the cutting device 270 may be rigidly mounted to a bottom portion of the guillotine head 290 and extend a relatively short distance below the guillotine head 290, but the card holder 272 may extend into the movement channel of the cutting assembly 284 and also extend farther below the guillotine head 290 in the y-direction than the cutting device. As such, while the mounting of the card holder 272 to the guillotine head 290 via the compression springs 296 provides for movement of the card holder 272 relative to the guillotine head 290 when the compression springs 296 are compressed, the rigid affixing of the cutting device 270 to the bottom portion of the guillotine head 290 does not permit flexibility in the position of the cutting device 270 relative to the guillotine head 290. Accordingly, as the cutting assembly 284 is moved toward the table 250 due to motion of the drive motor via the cam, the card holder 272 and the cutting device 270 also move downward toward the table 250. When a bottom portion of the card holder 272 (e.g., clamp 300) reaches the blister card 50 and presses the blister card 50 to engage the table 250, the guillotine head 290 may continue to move downward, thereby compressing the compression springs 296. The compression of the compression springs 296 may increase the force applied by the card holder 272 to the blister card 50 via the clamp 300. Accordingly, the clamp 300 may flatten the blister card 50 and maintain the blister card 50 in a flattened and secured state while cutting of the blister card 50 is accomplished via the cutting device 270 when the cutting assembly 284 moves through its full range of motion along its downward path for cutting. In other words, in some embodiments, there is a time period between the time the compression springs 296 begin to compress and the time at which the cutting device 270 reaches the blister card 50 to cut the blister card 50.

In an exemplary embodiment, the clamp 300 may include a slot 302 formed to at least permit movement of the positioning device 274 (or more specifically the upper arm 280) to reach past the card holder 272 (e.g., through the slot 302 formed in the clamp 300) to grip remaining portions of the blister card 50 after a portion of the blister card 50 has been removed by operation of the cutting device 270. The table 250 may have a slot arranged to coincide with the slot 302 on the clamp 300 so the positioning device 274 (or more specifically the lower arm 281) may reach substantially into the table 250 to grab a portion of the blister card 50 remaining after cutting since no portion of the blister card 50 may extend past an edge of the table 250 at that point. In some embodiments, verification of proper positioning of the clamp 300 relative to the blister card 50 (and more specifically relative to the unit dose medication 30 and/or the vinyl cavity 80) may be required prior to enabling the cutting device 270 to cut the blister card 50. In this regard, for example, a sensor 306 may be employed to determine whether the clamp 300 is fully seated prior to operation of the cutting device 270.

In an example embodiment, the sensor 306 may be positioned at a position along the linear path traveled by the guillotine head 290 at a point that enables confirmation of full seating of the clamp 300 relative to the table 250. As such, for example, if the clamp 300 fails to seat properly with respect to the table 250 and the blister card 50 disposed on the table 250, the sensor 306 may detect the failure to seat condition. In some embodiments, a position of the clamp 300 itself may be detected (e.g., either a top or bottom most position of the clamp 300 in reference to the y-direction) by the sensor 306 to determine whether the clamp 300 is seated. However, in other embodiments, a position of the guillotine head 290 itself or another portion of the card holder 272 may be detected. Thus, for example, the sensor 306 may employ physical contact-based detection (e.g., sensing contact or pressure exerted by the clamp 300), optical-based detection, detection based on a proximity switch or contact being triggered when a portion of the guillotine head 290 or clamp 300 reaches a particular position, and/or other like detection mechanisms.

The sensor 306 may be configured to provide a signal to the processor 200 regarding the seat condition of the clamp 300 to enable the processor 200 to control operation of the cutting process based on the seat condition of the clamp 300 as indicated by the sensor 306. Accordingly, for example, responsive to downward movement of the guillotine head 290, the sensor 306 may detect the seat condition of the clamp 300 and enable or interrupt completion of movement of the guillotine head 290 through the full range of motion required to affect cutting of the blister card 50. In this regard, as the card holder 272 moves downward the compression springs 296 are not initially compressed. However, the card holder 272 is attached to the guillotine head 290 such that some level of compression of the compression springs 296 is to occur prior to the cutting device 270 reaching the blister card 50. As such, when the clamp 300 stops its downward motion due to encountering an object blocking further downward movement (e.g., the table 250 or a unit dose medication 30 and/or the vinyl cavity 80), the compression springs 296 may begin to compress. At some point between the position at which the commencement of compression of the compression springs 296 begins and downward motion of the guillotine head 290 initiates cutting of the blister card 50 via the cutting device 270, a signal from the sensor 306 may be required to continue the downward motion of the guillotine head 290 to commence cutting of the blister card 50 with the cutting device 270.

In some embodiments, the drive motor may employ an encoder or other position tracking mechanism so that the position of the drive motor can be tracked. As the drive motor turns, the sensor 306 may provide feedback to the drive motor regarding the position of the clamp 300. As such, under normal operating conditions, the clamp 300 may be expected to fully seat at a corresponding drive motor position. When the drive motor position corresponding to clamp seating is reached, if the sensor 306 has not yet detected clamp seating, the drive motor (e.g., via the processor (200) may be made aware that the clamp 300 is not in the correct position so that the drive motor can either stop turning or reverse direction to avoid cutting any medication that may be blocking the clamp 300 from seating properly. As an example, if the drive motor knows that when it rotates the cam sixty degrees, the clamp 300 should be seated, the drive motor 300 may turn to sixty degrees and expect a signal from the sensor 306 indicating seating of the clamp 300. If the signal is not received at sixty degrees, as expected, a fault may be detected and the cycle may be stopped. As an alternative to an actual position sensor, timing measurements could be employed. For example, the motor may turn a set amount of time and expect an input from the sensor 306 to indicate that the clamp 300 has seated. In the absence of receiving the input when the set amount of time is reached, a fault may be detected as described above.

FIG. 7B illustrates an example in which a cutting operation is completed via the processes described above. In this regard, FIG. 7B shows the card holder 272 being pressed into the guillotine head 290 due to compression of the compression springs 296 in order to hold the blister card 50 while the cutting device 270 cuts the blister card 50. As shown in FIG. 7B, the sensor 306 may indicate that the clamp 300 is fully seated so that the blister card 50 is pressed flat to the table 250. Having received the indication that the clamp 300 is fully seated, the processor 200 may enable continuation of the cutting process by enabling the guillotine head 290 to be moved downward until the cutting device 270 cuts the blister card 50.

To the contrary, however, if the clamp 300 encounters an obstruction that prevents full seating of the clamp 300 (e.g., due to encountering a unit dose medication 30 and/or the vinyl cavity 80) as the guillotine head 290 descends to initiate cutting of the blister card 50, the failure of the clamp 300 to properly seat (or fully seat) with respect to the table 250 and/or the blister card 50 may cause the cutting process to be aborted. FIG. 7C illustrates an example in which a cutting operation is aborted according to an example embodiment. The sensor 306 may be configured to detect a failure to seat (or fully seat) condition and send an interrupt signal to the processor 200 in response to the clamp 300 engaging the unit dose medication 30 rather than pressing the blister card 50 substantially flat to the table 250 to fully seat. The processor 200 may receive the interrupt signal from the sensor 306 and stop movement of the guillotine head 290 in the downward direction to avoid cutting into the unit dose medication 30 and/or the vinyl cavity 80. In some cases, the processor 200 may initiate upward movement of the guillotine head 290 (e.g., by driving the drive motor in the opposite direction to the direction used for downward movement of the guillotine head 290) to reset the guillotine head 290. In some cases, an audible or visual alarm may also be provided to indicate the failure of the clamp 300 to seat properly and therefore also indicate that the cutting operation has been interrupted. If an interrupt signal is issued and an alarm is ultimately generated, it may be indicative of a situation where some slippage or another positioning error has occurred while the positioning device 274 positions the blister card 50 for a cutting operation. Accordingly, the operator may be informed that it is necessary to realign the blister card 50 or otherwise check on operation of the blister card cutter 180.

FIG. 8 also shows a more detailed view of the cutting device 270 according to an exemplary embodiment. In this regard, FIG. 8A illustrates the cutting device 270 arranged as a self aligning cutting device to provide improved cutting performance. FIG. 8B illustrates a guillotine assembly 315 for holding the guillotine head 290 and providing a cutting base 317 according to an example embodiment. To provide a self aligning characteristic to the cutting device 270, the cutting device 270 may include a blade 310, torsion springs 312 and a blade carriage 314. FIG. 9, which includes FIGS. 9A and 9B, illustrates perspective views of the cutting device 270 according to an example embodiment and FIG. 10 illustrates a front view of the cutting device 270 as mounted on the guillotine head 290 according to an example embodiment. The structure of the cutting device 270 will now be described in reference to FIGS. 7 to 10 in order to explain the self aligning nature of the cutting device 270 of this example embodiment.

In an example embodiment, the blade 310 may be mounted to a shaft 316 that is rotatably mounted to the blade carriage 314. The blade 310 may be substantially rectangular when viewed from a perspective that presents the widest and longest dimensions of the blade 310. However, other blade shapes are also possible so long as the blade edge is parallel to the axis of rotation of the blade 310. A depth of the blade 310 may be relatively small as compared to the length and width dimensions. The blade 310 may have a cutting end 318 running substantially the length of one of the longitudinal edges of the blade 310 and a fastening end 320 positioned at an edge opposite of the cutting end 318.

Because the blade 310 is mounted to the shaft 316 (e.g., via blade mount 319), the blade 310 may be enabled to rotate with respect to the shaft 316. The blade carriage 314 may then be affixed to the guillotine head 290 via fasteners 322. The fasteners 322, which may be embodied as rivets, screws, weld joints, or any other suitable fastening device, may hold the blade carriage 314 in contact with the guillotine head 290. In some cases, the blade 310 may be mounted to the blade carriage 314 via the shaft 316 such that the blade 310 extends substantially at a tangent to the surface of the shaft 316. Moreover, the blade carriage 314 may be constructed such that when the blade carriage 314 is mounted to the guillotine head 290 with the card holder 272 installed, a portion of the blade 310 between the cutting end 318 and the fastening end 320 may lie substantially adjacent to and substantially in a parallel plane to a plane in which a face of the card holder 272 lies.

In an example embodiment, the card holder 272 may move within a channel (shown generally at 321) of the cutting base 317 that is attached to an end portion of the table 250 and attaches to guillotine assembly 315 within which the guillotine head 290 moves via linear bearings. The cutting base 317 may be aligned with an edge of the table 250 to provide a self alignment surface for the blade 310. As such, the torsion springs 312 may be affixed to the shaft 316 and biased to provide a force to a side of the blade 310 that is opposite with respect to the side of the blade 310 that faces the card holder 272 and the cutting base 317. The torsion springs 312 may therefore bias the blade 310 for contact with the cutting base 317 during the cutting process. As such, the blade 310 may slide along shoulder portions of the cutting base 317 that define the channel 321 until the blade 310 completes the cut. Accordingly, since the card holder 272 actually stops moving when the clamp 300 is seated and compresses the compression springs 296 while the guillotine head 290 continues downward motion, the blade 310 may slide along the cutting base 317 proximate to the card holder 272, which travels in the channel 321, as it approaches the blister card 50. By holding the blade 310 in contact with the cutting base 317 using the torsion springs 312, even if there is wear of components over time, the torsion springs 312 dynamically accommodate for any gaps that would otherwise be created to maintain close tolerances for a clean and efficient cut of the blister card 50.

In an example embodiment, to improve cutting performance, the blade 310 may also be mounted such that the cutting end 318 of the blade 310 lies at an angle relative to the surface of the blister card 50 (or the plane in which the table 250 lies). By mounting the blade 310 at an angle, as described above, the cutting end 318 may only be in contact with the blister card 50 at a single point at any instant in time thereby requiring a lower force to execute the cutting of the blister card 50. For example, the portion of the cutting end 318 that is mounted lower (in the y-direction) may initially engage an end of the blister card 50 and commence cutting. The portion of the cutting end 318 that is in contact with the blister card 50 (and therefore cutting the blister card 50) may then shift across the length of the blade 310 until the portion of the cutting end 318 that is mounted higher completes the cut as the cutting end 318 passes from initially being adjacent to the face of the card holder 272 to being adjacent to the edge of the table 250. Accordingly, the blade 310 is enabled to cut the blister card 50 with a scissor action.

To mount the blade 310 such that the cutting end 318 lies at an angle relative to the surface of the blister card 50 during cutting, several different options may be employed. For example, in some cases, the blade carriage 314 may be constructed to hold the shaft 316 at an angle relative to the surface of the table 250. As yet another alternative, the blade carriage 314 may be mounted to the guillotine head 290 at an angle or, as is shown in FIG. 10, the guillotine head 290 could be constructed such that a bottom edge of the guillotine head 290 lies at an angle relative to the surface of the table 250. As such, any arrangement may be employed so long as the edge of the blade 310 remains parallel to the axis of rotation of the blade.

Accordingly, embodiments of the present invention may provide a blister singulator (an example of which is shown as the blister singulator 160 of FIG. 11) that provides a single point of contact between the cutting blade and the media being cut (e.g., the blister card 50) during the cutting of the media. A lower driving force may therefore be employed. Additionally, embodiments may provide for mounting the cutting blade to an assembly that provides a constant rotational force (through torsion springs). The cutting blade's edge is therefore held against the front surface of the cutting base at a vertical angle. To accomplish this, the cutting blade's edge may be substantially parallel to the rotational axis on which the blade is mounted. As the cutting base wears, the torsion springs rotate the cutting blade to maintain contact to provide a scissor-like clean cut of the media. Additionally, a card holder is provided that clamps cards flat as they are being cut. The edge of the clamp initially travels with and slightly ahead of the cutting blade. A sensor is also employed to ensure that a mechanical check is performed for drugs or other material in the path of the cutting blade (other than the media). If drugs or other materials are encountered, the sensor is triggered and an interrupt is sent to a controller to stop the cutting process. The interruption of the cutting process may save the cost of the destroyed drugs or other materials and contamination of the equipment from unintended cuts. If, on the other hand, no drugs or materials are encountered, the clamp flattens the media and holds it tight against the cutting surface by employing compression springs and a linear guide system. The cutting blade then is permitted to cut through the media when the clamp is seated. The clamp progressively increases the holding force as the cutting blade travels through the media, eliminating movement and/or curling of the media.

FIG. 12 is a flowchart of a method and program product according to exemplary embodiments of the invention. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device and executed by a processor (e.g., processor 200). As will be appreciated, any such computer program instructions may be loaded onto a computer or other programmable apparatus (i.e., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture including instruction means which implement the function specified in the flowchart block (s). The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart block(s).

In this regard, a method of facilitating cutting unit dose blisters from a blister card may include moving a clamp into contact with a portion of the blister card to press the blister card into contact with a platform at operation 400, determining a seating state of the clamp with a sensor at operation 410, and enabling cutting of the blister card via a blade in slidable contact with cutting base based on the seating state at operation 420.

In some embodiments, optional operations may be provided in addition to the operations described above. It should be appreciated that each of the optional operations described below may be included with the operations above either alone or in combination with any others among the features described herein. Accordingly, in some embodiments, the method may further include providing an interrupt signal from the sensor in response to the clamp failing to fully seat prior to the blade reaching a plane of the platform at operation 430. In some embodiments, the operations described above may be modified. The modifications may be included in any combination and in any order. As such, in some cases, determining the seating state may include determining whether the clamp is fully seated with respect to the blister card and the platform. In some embodiments, enabling cutting may include enabling movement of the blade through a plane of the platform in response to the clamp being fully seated.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions other than those explicitly described above are also contemplated as may be set forth in some of the appended claims. Although specific terms are employed herein, they are used in a generic and descriptive sense only and not for purposes of limitation.

That which is claimed:

1. An apparatus for cutting a blister card, the apparatus comprising:

a platform on which the blister card is positionable for cutting;

a guillotine head comprising at least one elastic element, wherein the at least one elastic element comprises a compression spring;

a clamp comprising a portion of a card holder, the card holder being movable in a channel defined by a base, the clamp being positionable to hold a portion of the blister card in contact with the platform for cutting when the clamp is seated, the clamp being operatively coupled to a guillotine head by the at least one elastic element;

a blade operatively coupled to the guillotine head, the guillotine head being configured to move the blade through a range of motion that intersects a plane of the platform; and a sensor positioned to detect a seating status of the clamp to enable control of movement of the guillotine head based on the seating status, wherein the at least one elastic element is compressed to enable continued movement of the guillotine head through the range of motion that moves the blade to a position that intersects the plane of the platform to cut the blister card in response to the sensor detecting a seated condition of the clamp, and wherein the blade is in slidable contact against the base as the at least one elastic element is compressed.

2. The apparatus of claim 1, wherein the sensor determines a location of the clamp relative to the surface of the platform.

3. The apparatus of claim 1, wherein the sensor is configured to detect the seating status after the at least one compression spring begins to compress and before the guillotine head passes the blade through intersection with the plane of the platform.

4. The apparatus of claim 1, wherein the guillotine head is positioned to provide movement of the guillotine head in a plane that is substantially perpendicular to the plane of the platform.

5. The apparatus of claim 1, wherein the clamp provides pressure to hold a portion of the blister card in contact with the platform such that the pressure increases while the blade initially passes through the plane of the platform.

* * * * *